US012264825B2

(12) United States Patent
Yuan et al.

(10) Patent No.: US 12,264,825 B2
(45) Date of Patent: Apr. 1, 2025

(54) AIR GUIDING DEVICE, AIR CONDITIONER INDOOR UNIT AND AIR-CONDITIONING SYSTEM WITH AIR GUIDING PART AND FLOW STRAIGHTENING GRID

(71) Applicant: GD MIDEA AIR-CONDITIONING EQUIPMENT CO., LTD., Guangdong (CN)

(72) Inventors: Hongliang Yuan, Guangdong (CN); Weidong Zhang, Guangdong (CN); Fenghua Jiang, Guangdong (CN); Tao Rao, Guangdong (CN); Zheyuan Zhang, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 510 days.

(21) Appl. No.: 17/533,420

(22) Filed: Nov. 23, 2021

(65) Prior Publication Data

US 2022/0107096 A1 Apr. 7, 2022

Related U.S. Application Data

(63) Continuation of application No. PCT/CN2019/121702, filed on Nov. 28, 2019.

(30) Foreign Application Priority Data

May 31, 2019 (CN) ..... 201910472471.5
May 31, 2019 (CN) ..... 201910472472.X
(Continued)

(51) Int. Cl.
*F24F 1/0011* (2019.01)
*F24F 13/14* (2006.01)
*F24F 13/15* (2006.01)

(52) U.S. Cl.
CPC ..... *F24F 1/0011* (2013.01); *F24F 13/1413* (2013.01); *F24F 13/15* (2013.01)

(58) Field of Classification Search
CPC ..... F24F 1/011; F24F 13/1413; F24F 13/15; F24F 1/0057; F24F 13/08; F24F 13/14;
(Continued)

(56) References Cited

U.S. PATENT DOCUMENTS

2013/0082115 A1 4/2013 May et al.
2019/0041085 A1* 2/2019 Kono ..... F24F 13/1406

FOREIGN PATENT DOCUMENTS

CN 100594342 C 3/2010
CN 102141295 A 8/2011
(Continued)

OTHER PUBLICATIONS

Supplementary European Search Report dated Jun. 14, 2022 received in European Patent Application No. EP 19930990.7.
(Continued)

*Primary Examiner* — Edelmira Bosques
*Assistant Examiner* — Michael James Giordano
(74) *Attorney, Agent, or Firm* — Scully, Scott, Murphy & Presser, P.C.

(57) ABSTRACT

An air guiding device, an air conditioner indoor unit, and an air-conditioning system are provided. The air guiding device has an air guiding part used for guiding a flow of air blown out of an air outlet of the air-conditioning system. The air guiding part is rotatable, so as to change an angle used by the air guiding part for guiding the flow of air. At least one side of the air guiding part, which is in an airflow flowing direction, is provided with a flow straightening grid.

10 Claims, 15 Drawing Sheets

(30) Foreign Application Priority Data

| | | |
|---|---|---|
| May 31, 2019 | (CN) | 201920836116.7 |
| May 31, 2019 | (CN) | 201920836120.3 |
| Jun. 28, 2019 | (CN) | 201910572692.X |
| Oct. 29, 2019 | (CN) | 201911036314.6 |
| Oct. 29, 2019 | (CN) | 201921837997.0 |

(58) Field of Classification Search
CPC .... F24F 13/24; F24F 2013/247; F24F 13/082; F24F 13/1426; F24F 13/20; F24F 1/0007; F24F 1/0003
See application file for complete search history.

(56) References Cited

FOREIGN PATENT DOCUMENTS

| | | | | | |
|---|---|---|---|---|---|
| CN | 102901198 | A | | 1/2013 | |
| CN | 103629743 | A | | 3/2014 | |
| CN | 103644636 | A | | 3/2014 | |
| CN | 203533817 | U | | 4/2014 | |
| CN | 103836781 | A | | 6/2014 | |
| CN | 203628975 | U | | 6/2014 | |
| CN | 103982999 | A | | 8/2014 | |
| CN | 104456717 | A | | 3/2015 | |
| CN | 104776582 | A | | 7/2015 | |
| CN | 204648609 | U | | 9/2015 | |
| CN | 205137699 | U | | 4/2016 | |
| CN | 103982999 | B | | 6/2016 | |
| CN | 106287970 | A | * | 1/2017 | ..... F24F 1/0007 |
| CN | 205860349 | U | | 1/2017 | |
| CN | 106369672 | A | * | 2/2017 | ..... F24F 1/0007 |
| CN | 107084482 | A | | 8/2017 | |
| CN | 107131564 | A | | 9/2017 | |
| CN | 107490071 | A | | 12/2017 | |
| CN | 207214389 | U | | 4/2018 | |
| CN | 108332287 | A | | 7/2018 | |
| CN | 207778584 | U | | 8/2018 | |
| CN | 108662737 | A | | 10/2018 | |
| CN | 108758833 | A | * | 11/2018 | ..... F24F 1/0025 |
| CN | 208418954 | U | | 1/2019 | |
| CN | 208536314 | U | | 2/2019 | |
| CN | 208652867 | U | | 3/2019 | |
| CN | 208765204 | U | | 4/2019 | |
| CN | 210197625 | U | | 3/2020 | |
| CN | 210463487 | U | | 5/2020 | |
| CN | 210861619 | U | | 6/2020 | |
| CN | 106642334 | B | | 6/2022 | |
| EP | 2327938 | A1 | | 6/2011 | |
| EP | 2835597 | B1 | | 3/2019 | |
| JP | H109658 | A | | 1/1998 | |
| WO | 2015192524 | A1 | | 12/2015 | |

OTHER PUBLICATIONS

First OA for CN application 201910572692.X dated May 14, 2021.
Second OA for CN application 201910572692.X dated Nov. 3, 2021.
ISR for PCT application PCT/CN2019/121702 dated Feb. 24, 2020.
First Office Action dated Feb. 1, 2024 received in Chinese Patent Application No. CN 201911036314.6.
Office Action dated Sep. 24, 2024 received in Chinese Patent Application No. 201910472472.X.
Office Action dated Aug. 31, 2024 received in Chinese Patent Application No. 201910472471.5.

* cited by examiner

AIR GUIDING DEVICE, AIR CONDITIONER INDOOR UNIT AND AIR-CONDITIONING SYSTEM WITH AIR GUIDING PART AND FLOW STRAIGHTENING GRID

CROSS-REFERENCE TO RELATED APPLICATIONS

The present application is a continuation application of PCT International Application No. PCT/CN2019/121702, filed on Nov. 28, 2019, which claims priority to and benefits of Chinese Patent Application Nos. 201910472471.5, 201920836116.7, 201910472472.X and 201920836120.3, filed on May 31, 2019; Chinese Patent Application Nos. 201921837997.0 and 201911036314.6, filed on Oct. 29, 2019; and Chinese Patent Application No. 201910572692.X, filed on Jun. 28, 2019, the entire contents of which are incorporated herein by reference for all purposes. No new matter has been introduced.

FIELD

The present disclosure relates to the field of air-conditioning technologies, and particularly to an air guiding device, an air conditioner indoor unit having the air guiding device, and an air-conditioning system having the air conditioner indoor unit.

BACKGROUND

In related art, an air guiding device of an air conditioner is configured to guide airflow blown out of an air outlet of the air conditioner, and the air outlet of the air conditioner is also provided with a grid for straightening the airflow blown out. In a prior art, the air guiding device can change a flowing direction of the airflow by rotating. However, since the grid at the air outlet is fixed, when the air guiding device rotates, the grid cannot effectively straighten the airflow under different working conditions, and may even hinder airflow that is blown from certain angles, causing an adverse effect on the air output and temperature adjustment effect of the air conditioner.

SUMMARY

The present disclosure is intended to solve one of the technical problems in the related technologies to at least some extent.

For this reason, an objective of the present disclosure is to provide an air guiding device that can ensure that an air-conditioning system has a large air output and a good flow straightening effect.

Another objective of the present disclosure is to provide an air conditioner indoor unit with the above-mentioned air guiding device.

A yet another objective of the present disclosure is to provide an air-conditioning system with the above-mentioned air conditioner indoor unit.

An air guiding device according to an embodiment of the present disclosure, including: an air guiding part configured to guide airflow blown out of an air outlet of an air-conditioning system, the air guiding part being configured to rotate to change a guiding angle of the air guiding part for the airflow, at least one side of the air guiding part along a flowing direction of the airflow being provided with a flow straightening grid.

In the air guiding device according to the embodiment of the present disclosure, since the rotatable air guiding part is provided, at least one side of the air guiding part along the flowing direction of the airflow is provided with the flow straightening grid, and the flow straightening grid can rotate to different directions along with the air guiding part to straighten the airflow guided by the air guiding part, thereby achieving a good flow straightening effect and ensuring the air-conditioning system to have a large air output.

According to some embodiments of the present disclosure, a plurality of air guiding parts are provided, and all the air guiding parts are located in different positions at the air outlet.

According to some embodiments of the present disclosure, the plurality of air guiding parts are arranged in sequence along a length direction of the air outlet.

According to some embodiments of the present disclosure, two ends of the air outlet in the length direction are each provided with an air-guide-part drive device, and each of the air-guide-part drive devices is configured to drive one of the air guiding parts to rotate.

According to some embodiments of the present disclosure, three or more air guiding parts are provided, a mounting part is arranged between every two adjacent ones of the air guiding parts, the mounting parts are fixed on the air-conditioning system, each of the mounting parts is provided with an air-guide-part drive device, and each of the air-guide-part drive devices is configured to drive at least one of the air guiding parts to rotate.

According to some embodiments of the present disclosure, the plurality of air guiding parts are arranged in sequence along a width direction of the air outlet, and at least one end of the air outlet in a length direction is provided with an air-guide-part drive device for driving the air guiding part to rotate.

According to some embodiments of the present disclosure, an end cap is fitted over each of two ends of the air guiding device in a length direction of the air outlet, a mounting space is defined in the end cap, and an air-guide-part drive device for driving the air guiding part to rotate is arranged in the mounting space.

According to some embodiments of the present disclosure, the end cap is fixed to at least one of the air guiding parts and provided with an avoidance notch for avoiding the air-guide-part drive device when rotating together with the air guiding part.

According to some embodiments of the present disclosure, the end cap is fixed in the air-conditioning system.

According to some embodiments of the present disclosure, the air guiding device includes: a louver sweeping structure, a louver drive structure, and a louver transmission structure, at least one of the air guiding parts is provided with the louver sweeping structure, a plurality of sweeping blades of the louver sweeping structure are spaced apart and swingable along a rotation axis of the air guiding part, and the louver drive structure is configured to cause, through the louver transmission structure, the plurality of sweeping blades of the louver sweeping structure to swing along the rotation axis of the air guiding part.

According to some embodiments of the present disclosure, the air guiding part includes: an inner air guiding plate and an outer air guiding plate, the inner air guiding plate is connected to the outer air guiding plate, a mounting cavity is formed between the inner air guiding plate and the outer air guiding plate, a heat insulating material is arranged in the mounting cavity, and an airflow guide surface is formed on a side surface of the inner air guiding plate facing away from the mounting cavity.

According to some embodiments of the present disclosure, the airflow guide surface is provided with a mounting hole in communication with the mounting cavity, a part of the louver drive structure is configured to extend through the mounting hole into the mounting cavity, and the louver sweeping structure is mounted at the airflow guide surface.

According to some embodiments of the present disclosure, the inner air guiding plate, the outer air guiding plate and the sweeping blades are integrally formed.

According to some embodiments of the present disclosure, each of the air guiding parts includes an arc-shaped plate, a surface of the arc-shaped plate is configured as an airflow guide surface, an axis of a cylinder where the arc-shaped plate is located serves as a rotation axis of the air guiding part, and at least one end of the arc-shaped plate in an axial direction is provided with a connecting plate configured to be in rotatory fit with the air-guide-part drive device.

According to some embodiments of the present disclosure, the flow straightening grid has a horizontal flow straightening plate and a longitudinal flow straightening plate, the horizontal flow straightening plate and the longitudinal flow straightening plate are cross-connected to form a flow straightening hole, and the horizontal flow straightening plate is parallel to a circumferential end surface of the arc-shaped plate.

According to some embodiments of the present disclosure, the outer air guiding plate is configured to be in tight fit with an opening edge of the air outlet when the air guiding part guides the airflow blown out of the air outlet of the air-conditioning system.

According to some embodiments of the present disclosure, the air guiding part has a blocking position for blocking the air outlet, a hot air guiding position for guiding the airflow downward, and a cold air guiding position for guiding the airflow upward.

According to some embodiments of the present disclosure, when the air guiding part is at the hot air guiding position or the cold air guiding position, an outline of an airflow guide surface of the air guiding part is in smooth connection with an outline of an internal air channel of the air-conditioning system, the air guiding part is configured to rotate from the blocking position to the hot air guiding position by an angle $\alpha$, and the air guiding part is configured to rotate from the blocking position to the cold air guiding position by an angle $\beta$, wherein $\alpha$ is 30°-80° and $\beta$ is 40°-110°.

According to some embodiments of the present disclosure, the air guiding device includes a mounting box for accommodating a first motor and the mounting box includes an arc-shaped outer wall. The air guiding part is configured to be connected to the first motor so that the air guiding part is driven to rotate around the arc-shaped outer wall. A center point of a contour line of a cross section of the air guiding part is not coincident with a rotation axis of the air guiding part. A line on an inner surface of the air guiding part in parallel with the rotation axis serves as a reference line, and the reference line is parallel to the arc-shaped outer wall. When the air guiding part moves, a distance between the reference line and the arc-shaped outer wall is equal.

According to some embodiments of the present disclosure, the distance between the reference line and the arc-shaped outer wall is 1 mm-6 mm.

Further, the distance between the reference line and the arc-shaped outer wall is 3 mm.

According to some embodiments of the present disclosure, a cross section of the arc-shaped outer wall on a plane perpendicular to the rotation axis is a curve, and the curve is at least a part of an ellipse.

According to some embodiments of the present disclosure, the reference line is located in the middle of an inner surface of the air guiding plate.

According to some embodiments of the present disclosure, the air guiding part includes an inner air guiding plate and an outer air guiding plate, and the inner air guiding plate is connected to the outer air guiding plate. A surface of the inner air guiding plate facing away from the outer air guiding plate is configured as the inner surface, and a surface of the outer air guiding plate facing away from the inner air guiding plate is configured as an outer surface.

According to some embodiments of the present disclosure, the inner air guiding plate and the outer air guiding plate define a mounting cavity, and the mounting cavity has a connecting rib therein to connect the outer air guiding plate with the inner air guiding plate.

According to some embodiments of the present disclosure, at least one of the outer air guiding plate and the inner air guiding plate is arc-shaped.

According to some embodiments of the present disclosure, the air guiding device has a closed state for closing the air outlet of the air conditioner and an open state for opening the air outlet. The air guiding device includes: an outer air guiding plate; an inner air guiding plate arranged on the outer air guiding plate and slidable relative to the outer air guiding plate, the inner air guiding plate extending beyond a front edge or a rear edge of the outer air guiding plate to close the air outlet of the air conditioner together with the outer air guiding plate when the air guiding device is in the closed state, the inner air guiding plate being accommodated on an inner side of the outer air guiding plate when the air guiding device is in the open state; and a sliding drive device configured to drive the inner air guiding plate and the outer air guiding plate to slide relative to each other.

According to some embodiments of the present disclosure, when the air guiding device is in the closed state, the inner air guiding plate extends beyond the front edge of the outer air guiding plate.

According to some embodiments of the present disclosure, when the air guiding device is in the open state, a front edge of the inner air guiding plate coincides with the front edge of the outer air guiding plate.

According to some embodiments of the present disclosure, the inner air guiding plate and the outer air guiding plate are each an arc-shaped plate having a middle part protruding outward relative to front and rear edges.

According to some embodiments of the present disclosure, when the air guiding device is in the open state, the front edge and the rear edge of the inner air guiding plate are in contact with the outer air guiding plate respectively, and the middle part of the inner air guiding plate is spaced apart from the outer air guiding plate.

According to some embodiments of the present disclosure, the rear edge of the outer air guiding plate is provided with a limiting boss, and when the air guiding device is in the open state, the rear edge of the inner air guiding plate abuts against the limiting boss.

According to some embodiments of the present disclosure, one of an outer surface of the inner air guiding plate and an inner surface of the outer air guiding plate is provided with a sliding boss and the other one thereof is provided with a slideway. The slideway is slidably fitted in the slideway.

According to some embodiments of the present disclosure, the sliding boss is arranged on the outer surface of the inner air guiding plate and adjacent to a rear edge of the inner air guiding plate.

According to some embodiments of the present disclosure, the inner surface of the outer air guiding plate is provided with a rotating shaft base, and the outer air guiding plate is reversibly arranged on the air conditioner through the rotating shaft base.

According to some embodiments of the present disclosure, the inner air guiding plate is provided with an avoidance groove for avoiding the rotating shaft base.

According to some embodiments of the present disclosure, two rotating shaft bases are provided and arranged adjacent to two ends of the outer air guiding plate, respectively.

According to some embodiments of the present disclosure, the sliding drive device includes: a second motor; a gear in transmission connection with the second motor; and a rack arranged on the inner air guiding plate and engaged with the gear.

According to some embodiments of the present disclosure, two sliding drive devices are provided and arranged adjacent to two ends of the inner air guiding plate, respectively.

An air conditioner indoor unit according to an embodiment of the present disclosure includes the above-mentioned air guiding device.

In the air conditioner indoor unit according to the embodiment of the present disclosure, the flow straightening grid can rotate to different directions along with the air guiding part to straighten the airflow guided by the air guiding part, thereby achieving a good flow straightening effect and ensuring the air-conditioning system to have a large air output.

An air-conditioning system according to an embodiment of the present disclosure includes the above-mentioned air conditioner indoor unit.

In the air-conditioning system according to the embodiment of the present disclosure, the flow straightening grid can rotate to different directions along with the air guiding part to straighten the airflow guided by the air guiding part, thereby achieving a good flow straightening effect and ensuring the air-conditioning system to have a large air output.

Figure 1:
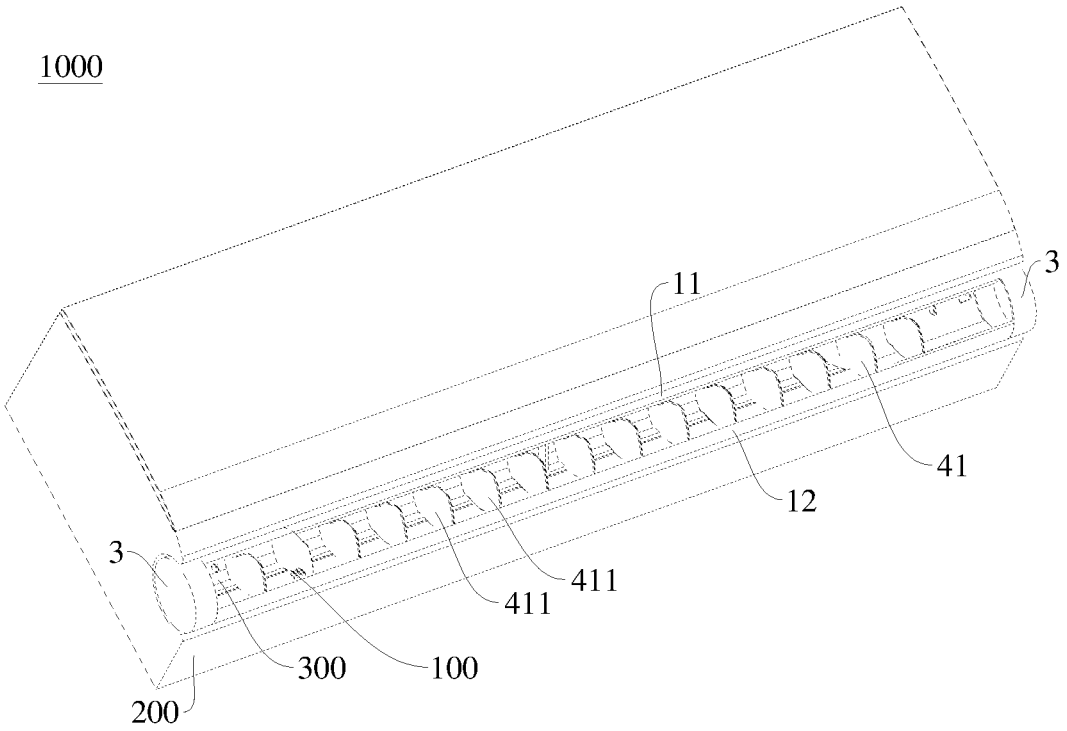
FIG. 1 is a schematic structural diagram of an air conditioner indoor unit according to an embodiment of the present disclosure.

REFERENCE NUMERALS air conditioner indoor unit 1000;

air guiding device 100; first air guiding part 11; second air guiding part 12; airflow guide surface 13; mounting hole 131;

connecting plate 14; inner air guiding plate 15; outer air guiding plate 16; mounting cavity 17; limit protrusion 18;

air-guide-part drive device 2; end cap 3; mounting space 31; avoidance notch 32; louver sweeping structure 41; sweeping blade 411; via hole 412; louver transmission structure 42; pull rod 421; transition transmission rod 422; push protrusion 423; limit hole; louver drive structure 43;

flow straightening grid 5; horizontal flow straightening plate 51; longitudinal flow straightening plate 52; flow straightening hole 53; integrated motor 6; bottom plate 200; air outlet 300;

limiting boss 161; slideway 163; rotating shaft base 162; sliding boss 151; avoidance groove 152; sliding drive device 30; second motor 310; gear 320, rack 330;

mounting box 110; outer wall 111; first motor 130; motor shaft 132.

DETAILED DESCRIPTION OF EMBODIMENTS

Embodiments of the present disclosure will be described below in detail. Examples of the embodiments are illustrated in the accompanying drawings, where the same or similar reference numerals throughout the specification refer to the same or similar elements or elements having the same or similar functions. The embodiments described below with reference to the accompanying drawings are exemplary and are intended to be illustrative, but should not be construed as limiting the present disclosure.

An air guiding device 100 according to an embodiment of the present disclosure will be described in detail below with reference to the accompanying drawings.

As shown in FIGS. 1-11, the air guiding device 100 according to the embodiment of the present disclosure may include an air guiding part (e.g., a first air guiding part 11, for illustrative purposes only), the air-conditioning system has an air outlet 300, and hot or cold air blown from the air-conditioning system can be blown into a room through the air outlet 300. The air guiding part is configured to guide airflow blown from the air outlet 300 of the air-conditioning system, and an airflow guide surface 13 for guiding the airflow from the air outlet 300 into the room is formed on one side of the air guiding part.

Figure 6:
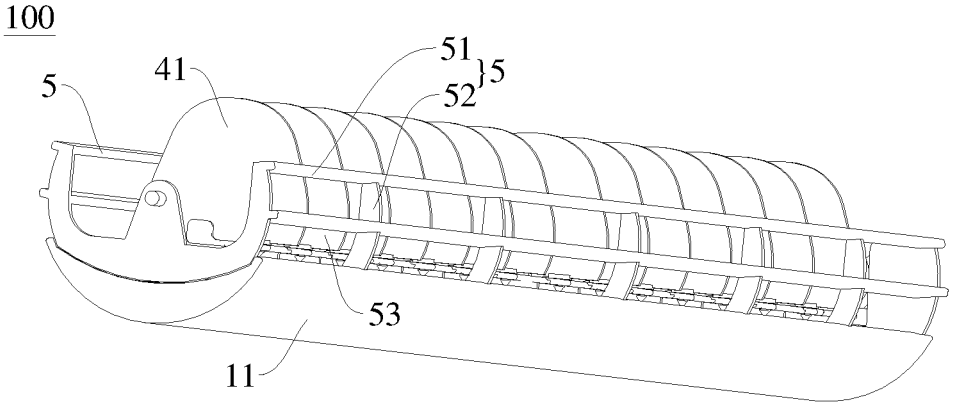
FIG. 6 is a schematic structural diagram of an air guiding device according to an embodiment of the present disclosure.
Figure 8:
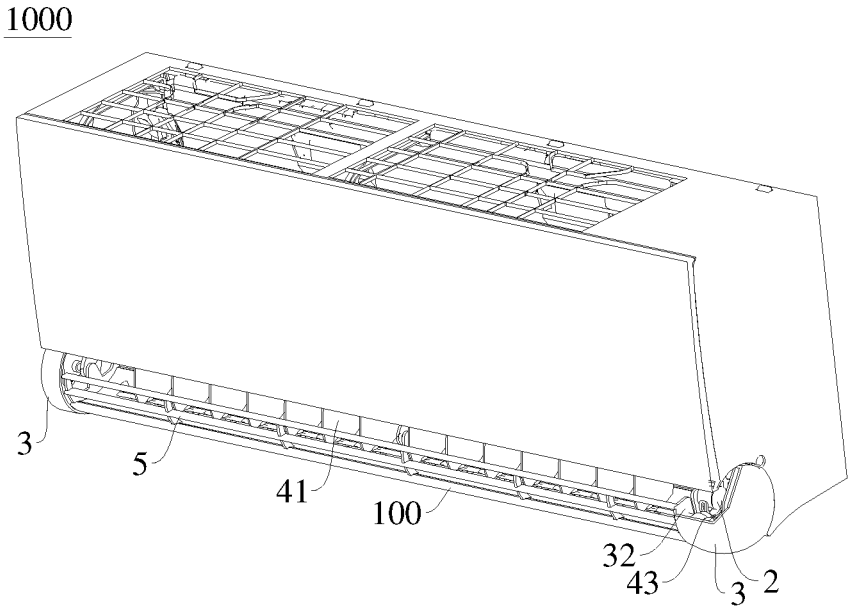
FIG. 8 is a schematic structural diagram of an air guiding device according to an embodiment of the present disclosure.
Figure 9:
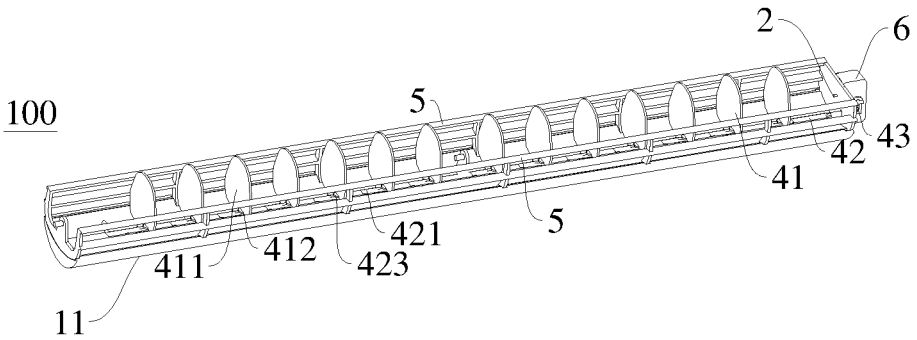
FIG. 9 is a schematic structural diagram of an air guiding device according to an embodiment of the present disclosure.

As shown in FIGS. 6, 8 and 9, at least one side of the air guiding part along a flowing direction of the airflow is provided with a flow straightening grid 5. The flow straightening grid 5 can straighten the airflow flowing through the air guiding part, so that the airflow is blown from the air outlet 300 into the room more evenly, thereby improving the heat exchange effect of the air-conditioning system. In addition, since the flow straightening grid 5 can rotate with the air guiding part, when the air guiding part rotates to different angles to guide the airflow to different directions, the flow straightening grid 5 can also straighten the airflow blown from this direction, thereby achieving a better flow straightening effect. In the meanwhile the flow straightening grid 5 always has a small obstruction to the airflow, so that the air-conditioning system has a large air output, thereby ensuring the temperature adjustment effect of the air-conditioning system.

As shown in FIGS. 1-4, the air outlet 300 is located near a bottom plate 200 of the air-conditioning system.

Figure 2:
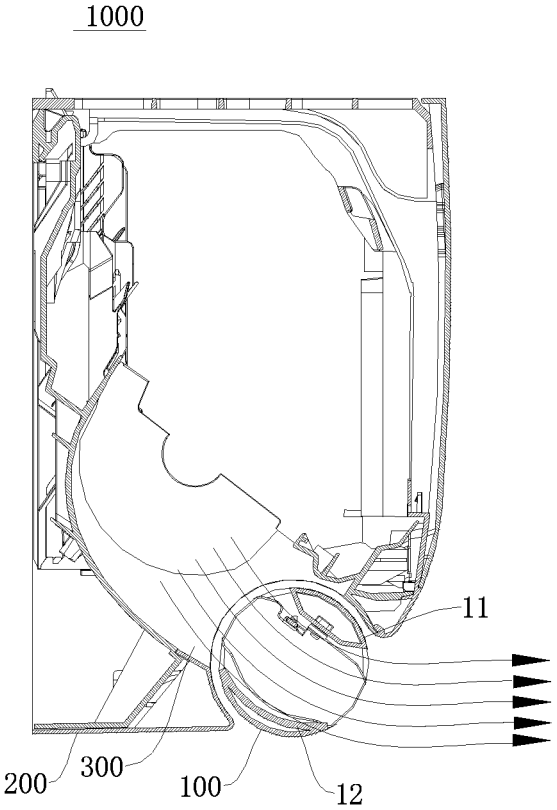
FIG. 2 is a schematic structural diagram of an air conditioner indoor unit according to an embodiment of the present disclosure during refrigeration.
Figure 3:
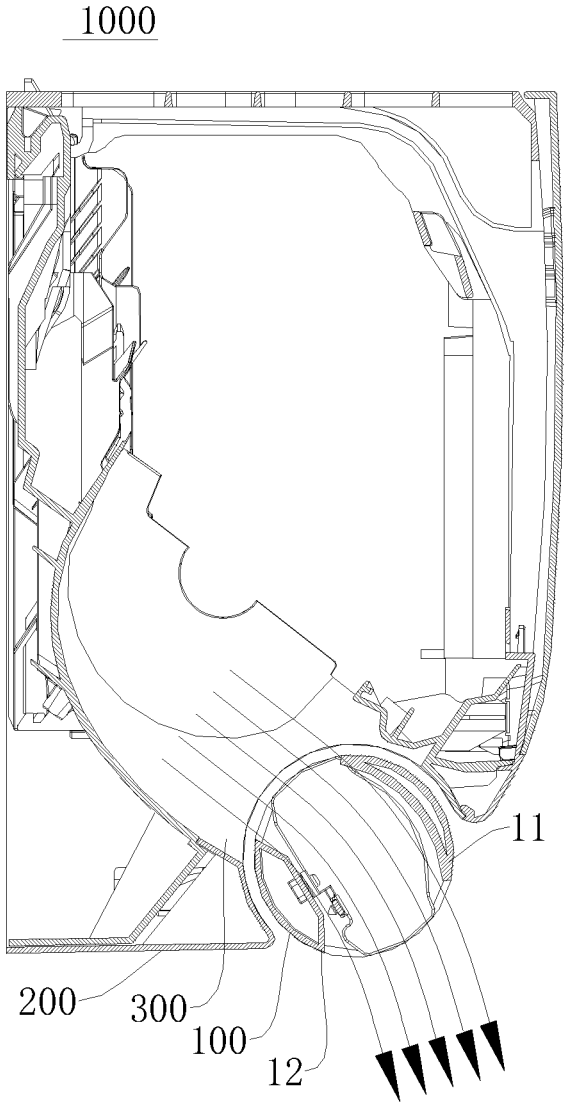
FIG. 3 is a schematic structural diagram of an air conditioner indoor unit according to an embodiment of the present disclosure during refrigeration.
Figure 4:
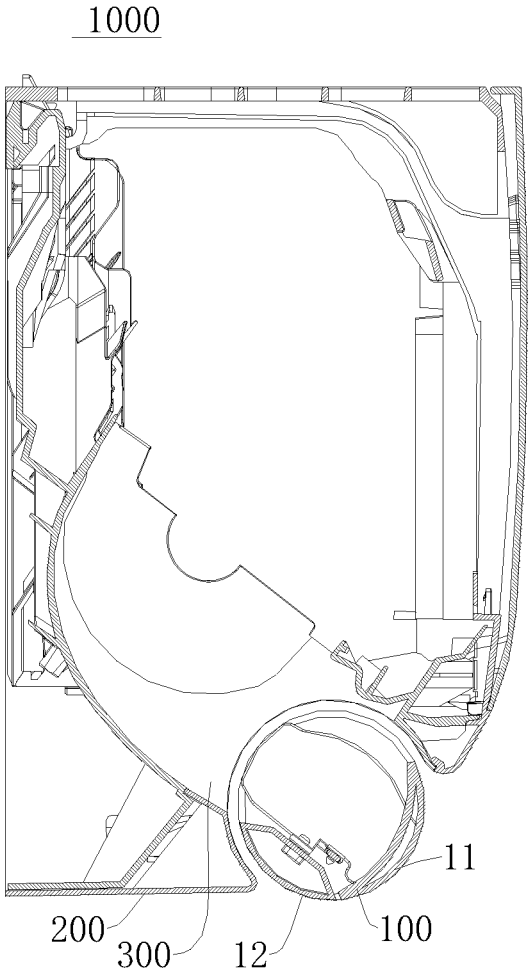
FIG. 4 is a schematic structural diagram of an air conditioner indoor unit according to an embodiment of the present disclosure when the air conditioner indoor unit stops working.

As shown in FIGS. 2-4, a plurality of air guiding parts (e.g., a first air guiding part 11 and a second air guiding part 12, for illustrative purposes only) are provided, and all the air guiding parts are located in different positions at the air outlet 300, and the air guiding part is configured to rotate to change a guiding angle of the air guiding part to the airflow. By rotating the different air guiding parts to different angles, the airflow blown from different positions of the air outlet 300 corresponding to the air guiding parts can be guided to different directions, which meets more blowing requirements of the air-conditioning system.

In some optional embodiments of the present disclosure, the plurality of air guiding parts are arranged in sequence along a length direction of the air outlet 300 (i.e., along a direction of the rotation axis of the air guiding part). In this way, the plurality of air guiding parts can guide the airflow blown from different positions in the length direction of the air outlet 300 to different directions, and the blowing angle is free, which can meet the requirement of the air-conditioning system to simultaneously blow airflow in multiple directions.

In some exemplary embodiments, two air guiding parts are provided and arranged along the length direction of the air outlet 300, and two ends of the air outlet 300 in the length direction are each provided with an air-guide-part drive device 2, and each of the air-guide-part drive devices 2 is configured to drive the air guiding part adjacent to the air-guide-part drive device 2 to rotate. For example, the air-guide-part drive device 2 is configured as a motor, and a motor output shaft of the air-guide-part drive device 2 may be connected to the air guiding part to drive the air guiding part to rotate.

In other exemplary embodiments, three or more air guiding parts are provided, and along the length direction of the air outlet 300, a mounting part is between every two adjacent air guiding parts. The mounting parts are fixed on the air-conditioning system (e.g., the mounting parts are fixed to a bottom plate 200 of the air-conditioning system), each of the mounting parts is provided with an air-guide-part drive device 2, and each of the air-guide-part drive device 2 is configured to drive at least one air guiding part to rotate. For example, each of the air-guide-part drive devices 2 can drive the adjacent air guiding part on one or two sides to rotate.

Figure 10:
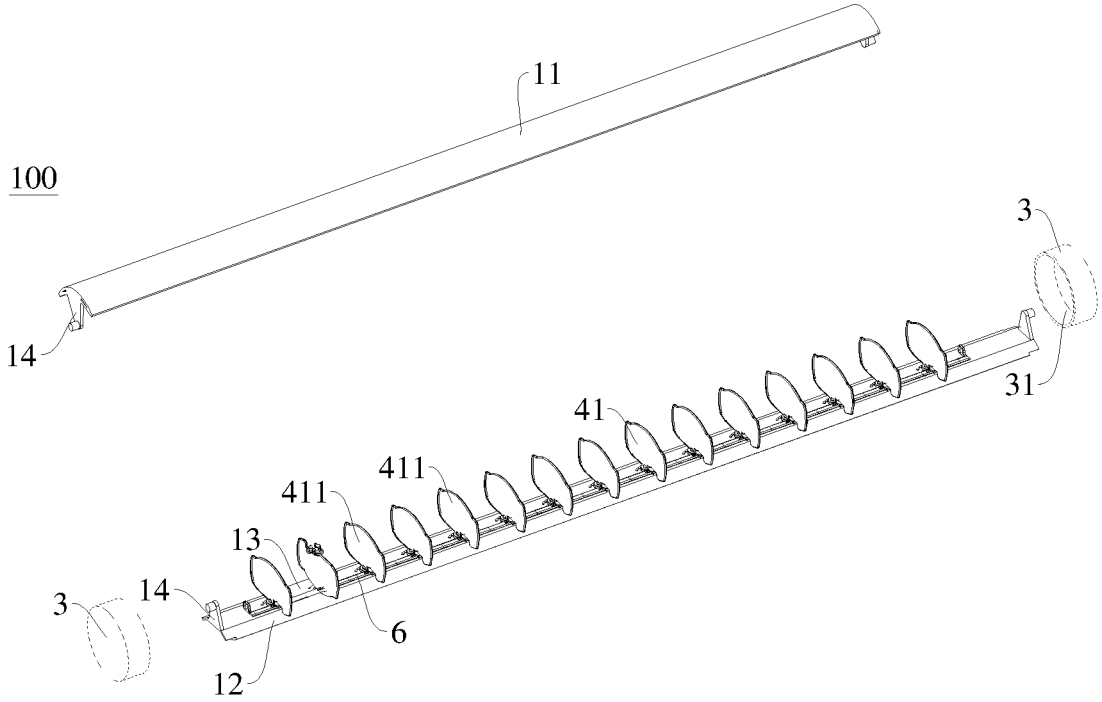
FIG. 10 is an exploded view of an air guiding part according to an embodiment of the present disclosure.
Figure 11:
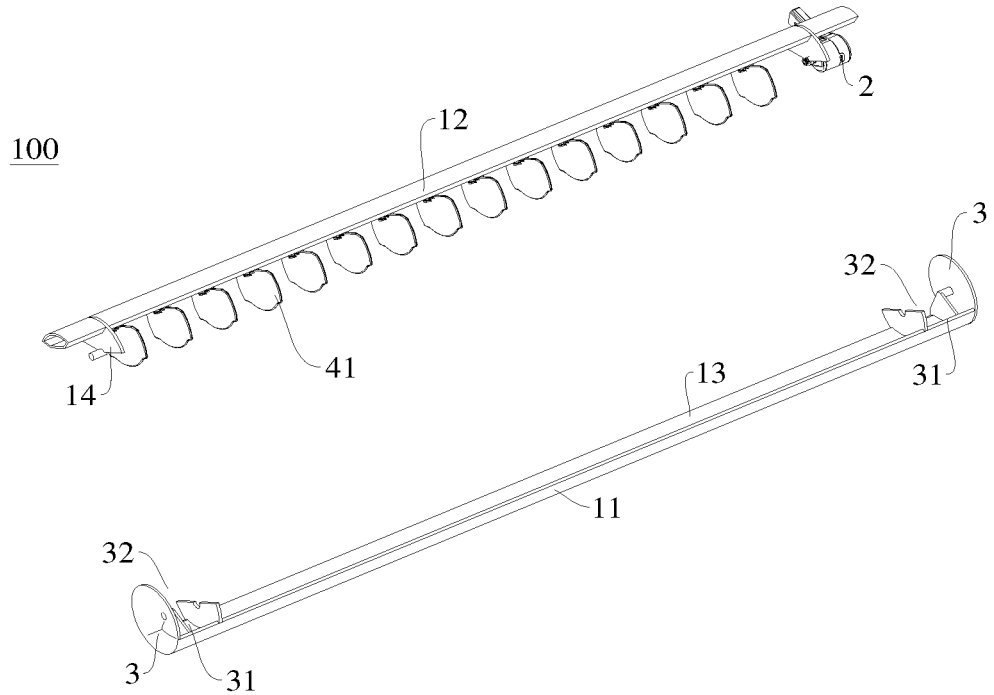
FIG. 11 is an exploded view of an air guiding part according to an embodiment of the present disclosure.

In other exemplary embodiments, as shown in FIGS. 10 and 11, a plurality of air guiding parts may also be arranged in sequence along the width direction of the air outlet 300 (i.e., along a circumferential direction of the rotation axis of the air guiding part). Therefore, by rotating different air guiding parts, an opening angle between two adjacent air guiding parts can be changed, and the airflow is blown into the room through a space between the two adjacent air guiding parts. Compared with the arrangement of only one air guiding part, this arrangement can make the airflow of the air outlet 300 have more blowing angles and a larger blowing area, so as to further meet the different needs of people on airflow blown. In addition, when only one air guiding part is required to blow the air, other air guiding parts can close the air outlet 300 to prevent dust from entering the air outlet 300.

As shown in FIG. 9, at least one end of the air outlet 300 in the longitudinal direction is provided with an air-guide-part drive device 2 for driving the air guiding part to rotate. The air-guide-part drive device 2 may be configured as a motor, and an output shaft of the motor may be connected with the air guiding part to drive the air guiding part to rotate.

For example, as shown in FIGS. 1 and 8, an end cap 3 is fitted over each of two ends of the air guiding device 100 in the length direction of the air outlet 300. The end cap 3 may be a cylindrical cap with an opening at one end in an axial direction. The end caps 3 may block the air guiding part at two axial ends to prevent external dust from entering the air outlet 300 from the two axial ends of the air guiding part.

The end cap 3 is provided therein with a mounting space 31, and the mounting space 31 is provided with an air-guide-part drive device 2 for driving the air guiding part to rotate, so that the end cap 3 protects the air-guide-part drive device 2 for driving the air guiding part.

In some exemplary embodiments, as shown in FIG. 11, the end cap 3 is fixed to at least one air guiding part, so that the end cap 3 can rotate together with the air guiding part. The end cap 3 is provided with an avoidance notch 32 for avoiding the air-guide-part drive device 2 when rotating together with the air guiding part. The avoidance notch 32 may be formed as an opening in a side wall of the end cap 3. The air-guide-part drive device 2 is fixed in the air-conditioning system (for example, the air-guide-part drive device 2 is fixed to the bottom plate 200 of the air-conditioning system) and does not rotate together with the end cap 3. When the end cap 3 rotates together with the air guiding part, the end cap 3 rotates relative to the air-guide-part drive device 2 and in this case the avoidance notch 32 can avoid the air-guide-part drive device 2.

In other exemplary embodiments, as shown in FIGS. 1 and 10, the end cap 3 is fixed in the air-conditioning system. The end cap 3 and the air-guide-part drive device 2 are both fixed in the air-conditioning system (for example, the end cap 3 and the air-guide-part drive device 2 are both fixed to the bottom plate 200 of the air-conditioning system). In this case, the air guiding part rotates relative to the end cap 3.

Figure 7:
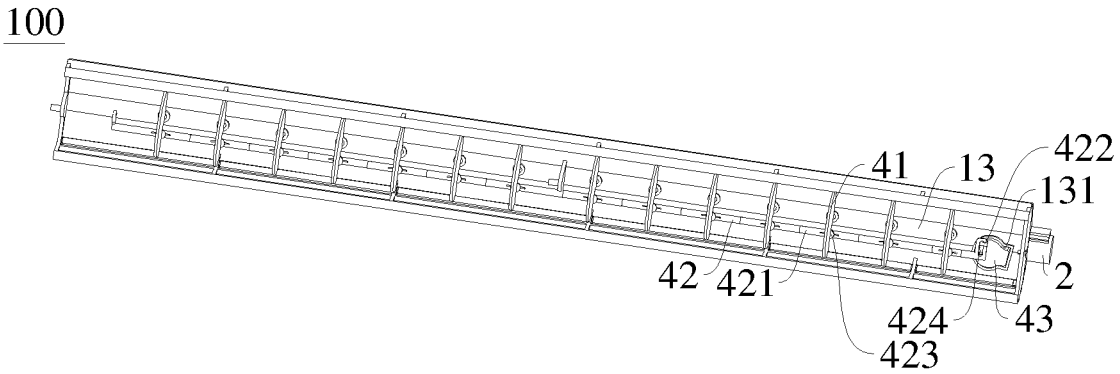
FIG. 7 is a schematic structural diagram of an air guiding device according to an embodiment of the present disclosure.

In some exemplary embodiments, as shown in FIGS. 7-9, at least one air guiding part is provided with a louver sweeping structure 41, and the louver sweeping structure 41 can rotate together with the air guiding part. The louver sweeping structure 41 does not need to be arranged in the air outlet 300, thereby reducing the space occupied by the louver sweeping structure 41 inside the air-conditioning system. The louver sweeping structure 41 has a plurality of sweeping blades 411, and the plurality of sweeping blades 411 are spaced apart and swingable along the rotation axis of the air guiding part. Therefore, when the airflow blown out from the air outlet 300 passes through the air guiding part, the plurality of sweeping blades 411 can further change the flowing direction of the airflow to meet different blowing requirements of users.

As shown in FIGS. 7 and 9, the air guiding device 100 further includes: a louver drive structure 43 and a louver transmission structure 42. The louver drive structure 43 is configured to cause, through the louver transmission structure 42, the plurality of sweeping blades 411 of the louver sweeping structure 41 to swing along the rotation axis of the air guiding part. In some embodiments, the sweeping blades 411 are perpendicular to the air guiding part. When the air-guide-part drive device 2 drives the air guiding to rotate, the sweeping blades 411 rotate together with the air guiding part, and in the meanwhile, the louver drive structure 43 drives the sweeping blades 411 to swing along the direction of the rotation axis of the air guiding part. In this way, the air guiding device 100 can continuously guide the airflow blown from the air outlet 300 to multiple directions, so that the airflow blows evenly in the room, thereby improving the heat exchange effect of the air-conditioning system In some exemplary embodiments, as shown in FIGS. 7 and 9, the bottom of each of the plurality of sweeping blades 411 (i.e., the side of the sweeping blade 411 facing the air guiding part) is provided with a via hole 412, the louver transmission structure 42 includes: a pull rod 421 and a transition transmission rod 422, the pull rod 421 is configured to pass through a plurality of via holes 412, an end of the pull rod 421 is provided with a limit hole 424, one end of the transition transmission rod 422 is configured to be fitted over the output shaft of the louver drive structure 43, the transition transmission rod 422 is configured to pass through the limit hole 424, and the limit hole 424 may be formed as an oblong hole. The output shaft of the louver drive structure 43 can drive the transition transmission rod 422 to rotate, so that the transition transmission rod 422 moves in the limit hole 424 and drives the pull rod 421 to move along the arrangement direction of the plurality of sweeping blades 411 (i.e., the axial direction of the air guiding part). It can be understood that the pull rod 421 can move bidirectionally in the arrangement direction of the sweeping blades 411.

As shown in FIG. 7, a plurality of pushing protrusions 423 are arranged in a length direction of the pull rod 421 and spaced apart, and each pushing protrusion 423 corresponds to a sweeping blade 411, for example, there is a pushing protrusion 423 between every two sweeping blades 411. The size or height of the pushing protrusion 423 is greater than that of the via hole 412, so as to prevent the pushing protrusion 423 from passing through the via hole 412 when the pull rod 421 moves. When the pull rod 421 moves along the arrangement direction of the plurality of sweeping blades 411, and each pushing protrusion 423 is engaged at the via hole 412 of one sweeping blade 411 and pushes the sweeping blade 411 to swing along the moving direction of the pull rod 421. The louver driving structure 43 can swing the sweeping blade 411 to different angles by changing the position of the pull rod 421. For example, the louver drive structure 43 may be configured as a motor.

In some embodiments, both the louver drive structure 43 and the air-guide-part drive device 2 can be fixed in the air-conditioning system (for example, fixed to the bottom plate 200), and the louver drive structure 43 and the air-guide-part drive device 2 can be mounted in the mounting cavity 17. In this way, the louver drive structure 43 can avoid the airflow guide surface 13 so that the airflow can be blown into the room through the airflow guide surface 13.

For example, the mounting cavity 17 of the end cap 3 is provided therein with an integrated motor 6. The integrated motor 6 has an air guiding part output shaft and a louver output shaft. The air guiding part output shaft forms the air-guide-part drive device 2, and the louver output shaft forms a louver drive structure 43. In this way, the integrated motor 6 can simultaneously output power to realize the rotation of the air guiding part and the swing of the sweeping blade 411, thereby achieving better integration effect and easier arrangement.

Further, a free end of a part of the transitional transmission rod 422 after passing through the limit hole 424 is provided with a bent limit segment configured to limit the pull rod 421, and the bent limit segment can prevent the transition transmission rod 422 from running out of the limit hole 424 when the pull rod 421 moves along the arrangement direction of the plurality of sweeping blades 411.

Figure 5:
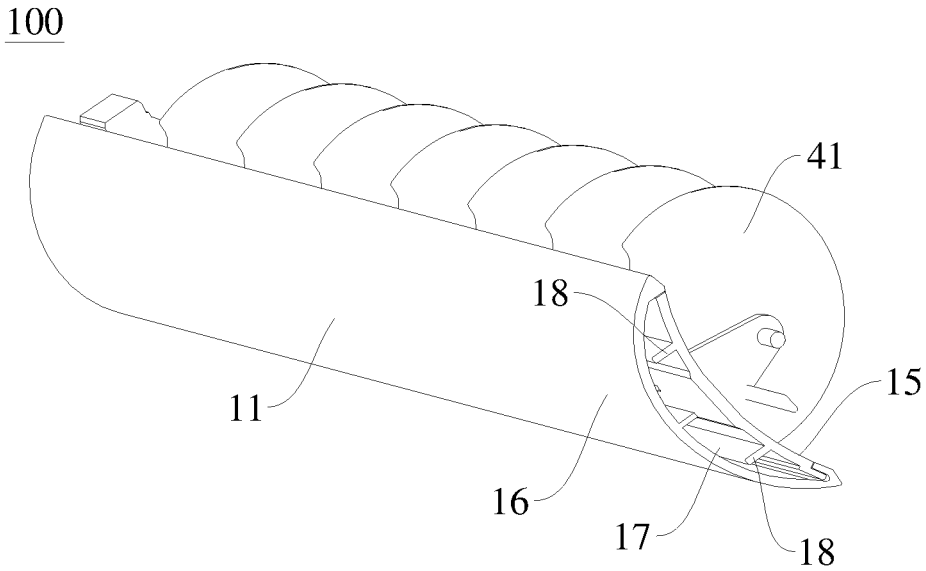
FIG. 5 is a schematic structural diagram of an air guiding device according to an embodiment of the present disclosure.

According to some embodiments of the present disclosure, as shown in FIGS. 5, 6 and 9, each air guiding part includes an arc-shaped plate, a surface of the arc-shaped plate is configured as an airflow guide surface 13, and an axis of a cylinder where the arc-shaped plate is located serves as a rotation axis of the air guiding part. In this way, the rotation process of the air guiding part can become more stable, and the air guiding angle of the air guiding part can be effectively increased. At least one end of the arc-shaped plate in the axial direction is provided with a connecting plate 14 configured to be rotatably matched with the air-guide-part drive device 2, so that the air-guide-part drive device 2 can drive the air guiding part to rotate.

As shown in FIG. 5, the air guiding part includes an inner air guiding plate 15 and an outer air guiding plate 16. The inner air guiding plate 15 and the outer air guiding plate 16 are connected, and a mounting cavity 17 is formed between the inner air guiding plate 15 and the outer air guiding plate 16. A heat insulating material is arranged in the mounting cavity, and the heat insulating material may be sponge. In this way, the air guiding part has strong heat insulating performance, and when the air flows through the air guiding part, the problem that condensed water is formed and returns to the air outlet 300. An airflow guide surface 13 is formed on a side surface of the inner air guiding plate 15 facing away from the mounting cavity 17.

For example, as shown in FIG. 5, a surface of the inner air guiding plate 15 facing the mounting cavity 17 or/and a surface of the outer air guiding plate 16 facing the mounting cavity 17 is/are provided with a limit protrusion 18 for positioning the heat insulating material. The limit protrusion 18 can firmly fix the heat insulating in the mounting cavity 17.

As shown in FIG. 7, the louver sweeping structure 41 is mounted at the airflow guide surface 13 and the airflow guide surface 13 is provided with a mounting hole 131 in communication with the mounting cavity 17. A part of the louver drive structure 43 is configured to extend into the mounting cavity 17 from the mounting hole 131. A part of the louver drive structure 43 extending out of the airflow guide surface 13 is mounted on the louver sweeping structure 41 through the louver transmission structure 42. In this way, the arrangement space of the louver drive structure 43 can be saved, and the case where the louver drive structure 43 at the airflow guide surface 13 is very large to obstruct the flowing of air can be prevented.

In some exemplary embodiments, the inner air guiding plate 15, the outer air guiding plate 16 and the sweeping blades 411 are integrally formed. Therefore, the air guiding part has high overall strength and is convenient to install. Further, the sweeping blade 411 is made of a flexible part (for example, a plastic part; the inner air guiding plate 15, the outer air guiding plate 16 and the sweeping blades 411 are integral injection molded parts), thereby facilitating deformation of the sweeping blades 411 relative to the inner air guiding plate 15 and the swing of the sweeping blades 411.

In other exemplary embodiments, the inner air guiding plate 15, the outer air guiding plate 16 and the sweeping blade 411 may be separately manufactured and subsequently fixed by means of bonding or the like. In this way, the manufacture of the air guiding part can be facilitated.

Further, as shown in FIG. 6, two sides of the air guiding part along the flowing direction of airflow are each provided with a flow straightening grid 5, and flow straightening holes 53 of the flow straightening grids 5 on two sides in the flowing direction of the airflow are directly opposite one to one. In this way, the airflow can be sequentially blown through the flow straightening holes 53 that are directly opposite, so that the flow straightening holes 53 on the two sides can better straighten the airflow blown out of the air outlet 300, thereby improving the heat exchange effect of the air-conditioning system.

Further, as shown in FIG. 6, the flow straightening grid 5 has a horizontal flow straightening plate 51 and a longitudinal flow straightening plate 52. The horizontal flow straightening plate 51 and the longitudinal flow straightening plate 52 are cross-connected to form a flow straightening hole 53, and the horizontal flow straightening plate 51 is parallel to a circumferential end surface of the arc-shaped plate. Therefore, the horizontal flow straightening plate 51 and the longitudinal flow straightening plate 52 have the smallest cross-sectional area in the air outlet direction of the air outlet 300, thereby preventing the horizontal flow straightening plate 51 and the longitudinal flow straightening plate 52 from obstructing the flowing of air, and ensuring that the air-conditioning system has a larger air output.

Further, the longitudinal flow straightening plate 52 can extend along the circumferential direction of the arc-shaped plate, and thus, the flow straightening grid 5 can form the circumferentially extending part of the arc-shaped plate, so that the arc surface of the air guiding part is larger, and a better visual effect is achieved.

For example, the outer air guiding plate 16 is configured to be in tight fit with an opening edge of the air outlet 300 when the air guiding part guides the airflow blown out of the air outlet 300 of the air-conditioning system. For example, when the air guiding part guides the airflow blown out of the air outlet 300 of the air-conditioning system, a gap between the outer air guiding plate 16 and the opening edge of the air outlet 300 can be less than 5 mm, so that the outer air guiding plate 16 and the opening edge of the air outlet 300 are relatively sealed to prevent dust from entering the air-conditioning system from the gap between the outer air guiding plate 16 and the opening edge of the air outlet 300.

According to some embodiments of the present disclosure, the air guiding part has a blocking position for blocking the air outlet 300, a hot air guiding position for guiding the airflow downward, and a cold air guiding position for guiding the airflow upward.

Since the specific gravity of hot air is lower than that of cold air, as shown in FIG. 2, when the air-conditioning system works for refrigeration, the air guiding part guides cold air blown out of the air outlet 300 to flow upward or diagonally upward into the room (as shown by the arrow in FIG. 2). In this case, the air guiding part is at the cold air guiding position and the cold air flows downward under the action of gravity after being blown into the room, so that the cold air can be evenly distributed in the room and the indoor cooling effect is better.

As shown in FIG. 3, when the air-conditioning system works for heating, the air guiding part guides hot air blown out of the air outlet 300 to flow downward or diagonally downward into the room (as shown by the arrow in FIG. 3). In this case, the air guiding part is at the hot air guiding position, and the hot air flows upward under the action of gravity after being blown into the room, so that the hot air can be evenly distributed in the room and the indoor heating effect is better.

In addition, as shown in FIG. 4, when the air-conditioning system stops working, no airflow is blown out of the air outlet 300, and the air guiding part can rotate to the blocking position to block the air outlet 300, so that the air guiding part can prevent external dust from entering the air-conditioning system through the air outlet 300 when the air-conditioning system stops working.

In some exemplary embodiments, when the air guiding part is at the hot air guiding position or the cold air guiding position, an outline of the airflow guide surface 13 of the air guiding part is in smooth connection with an outline of an internal air channel of the air-conditioning system. In other words, when the air guiding part is at the hot air guiding position, the outline of the airflow guide surface 13 of the air guiding part is in smooth connection with the outline of the internal air channel of the air-conditioning system at the air outlet 300, and hot air blown out of the air outlet 300 can be smoothly blown out from the air guiding part. When the air guiding part is at the cold air guiding position, the airflow guide surface 13 of the air guiding part is in smooth connection with the outline of the internal air channel of the air-conditioning system at the air outlet 300, and cold air blown out of the air outlet 300 can be smoothly blown out from the air guiding part.

The air guiding part is configured to rotate by an angle $\alpha$ from the blocking position to the hot air guiding position, and the air guiding part is configured to rotate by an angle $\beta$ from the blocking position to the cold air guiding position. For example, $\alpha$ is within a range of 30°-80°. Therefore, the angle of the air guiding part is reasonable so that the hot air blown out of the air outlet 300 during the heating of the air conditioner can be discharged smoothly, with a large air volume and low noise. For example $\beta$ is within a range of 40°-110°. Therefore, the angle of the air guiding part is reasonable so that the cold air blown out of the air outlet 300 during the refrigeration of the air conditioner can be discharged smoothly, with a large air volume and low noise.

For example, $\alpha$ is 55° and $\beta$ is 80°. As a result, the angle of the air guiding part is further reasonable, and the airflow blown out of the air outlet 300 can be discharged smoothly, with a large air volume and low noise.

Figure 12:
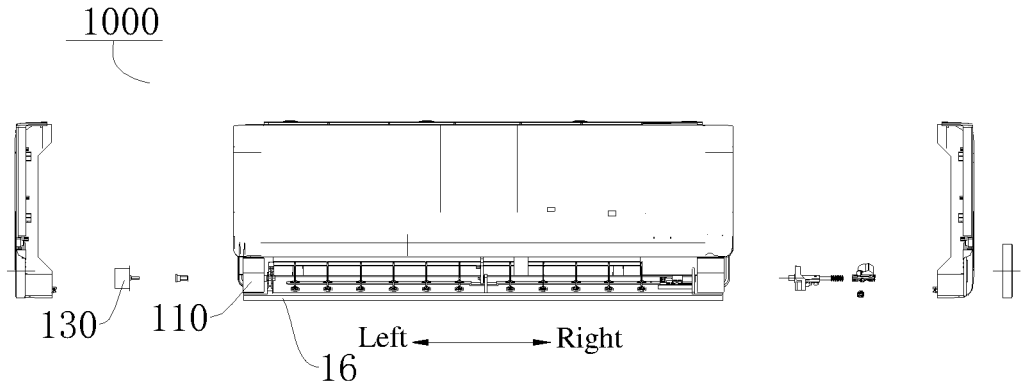
FIG. 12 is an exploded view of an air conditioner according to an embodiment of the present disclosure.
Figure 15:
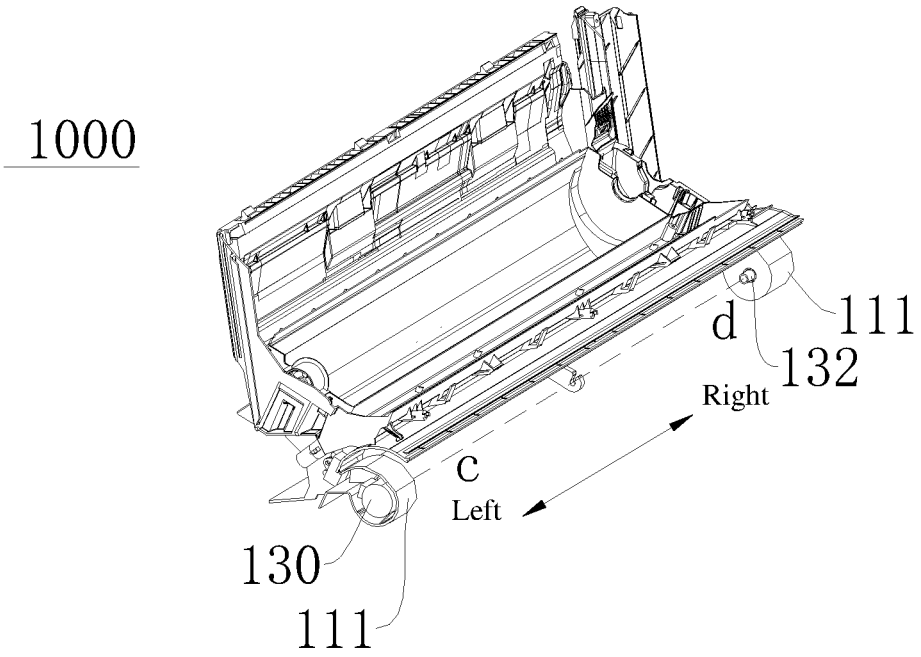
FIG. 15 is a schematic partial structural diagram of an air conditioner according to an embodiment of the present disclosure.
Figure 16:
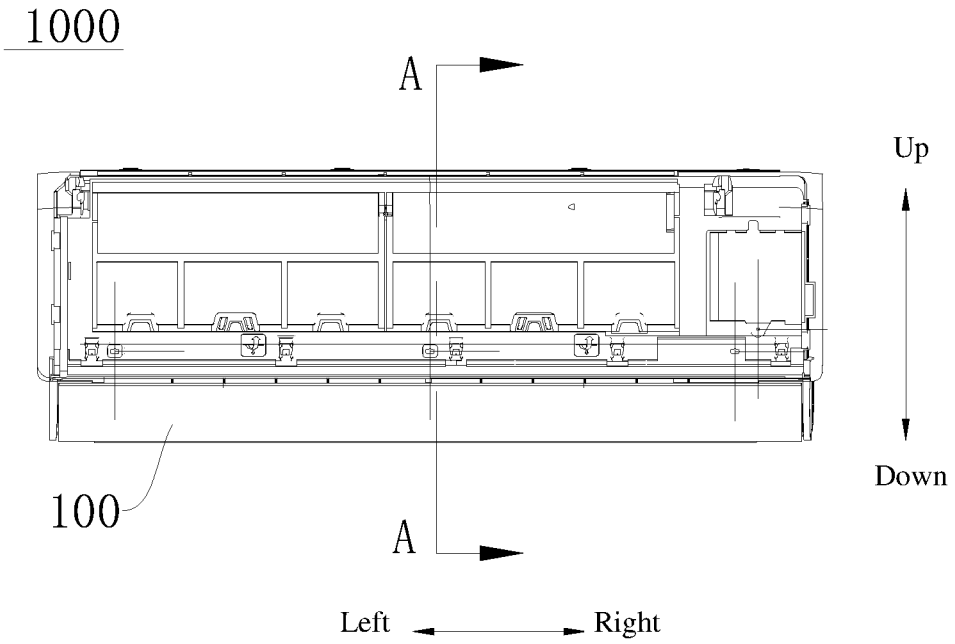
FIG. 16 is a schematic structural diagram of an air conditioner according to an embodiment of the present disclosure.
Figure 17:
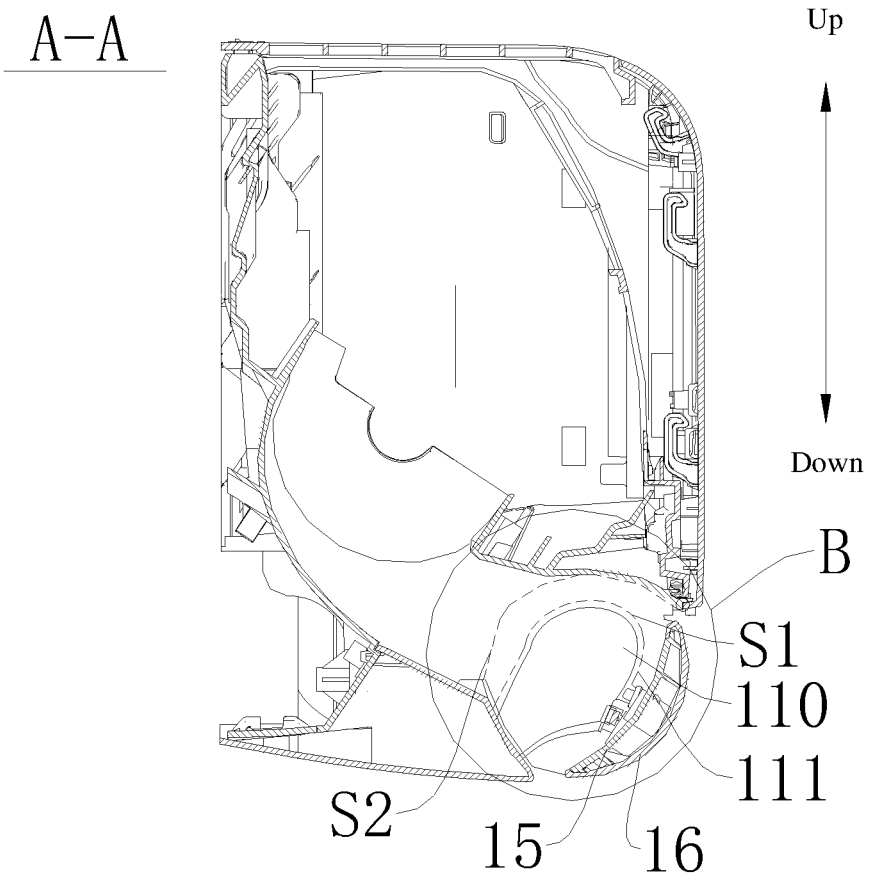
FIG. 17 is a cross-sectional view of FIG. 16 along direction A-A.

In some exemplary embodiments, as shown in FIGS. 12 and 15, the air guiding device 100 includes a mounting box 110 for accommodating the first motor 130. For example, the mounting box 110 can define an accommodating space for accommodating the first motor 130, and the mounting box 110 has an arc-shaped outer wall 111. The air guiding part is configured to be connected with the first motor 130 so that the air guiding part is driven to rotate around the arc-shaped outer wall 111. It should be noted that, as shown in FIG. 12, the air guiding part can be arranged around the outer periphery of the mounting box 110, so that the layout of the mounting box 110 and the layout the air guiding part can be prevented from mutual restriction in the extending direction of the air guiding part. In this way, the air guiding part has a large air supply range to improve the performance of the air conditioner indoor unit 1000.

Figure 18:
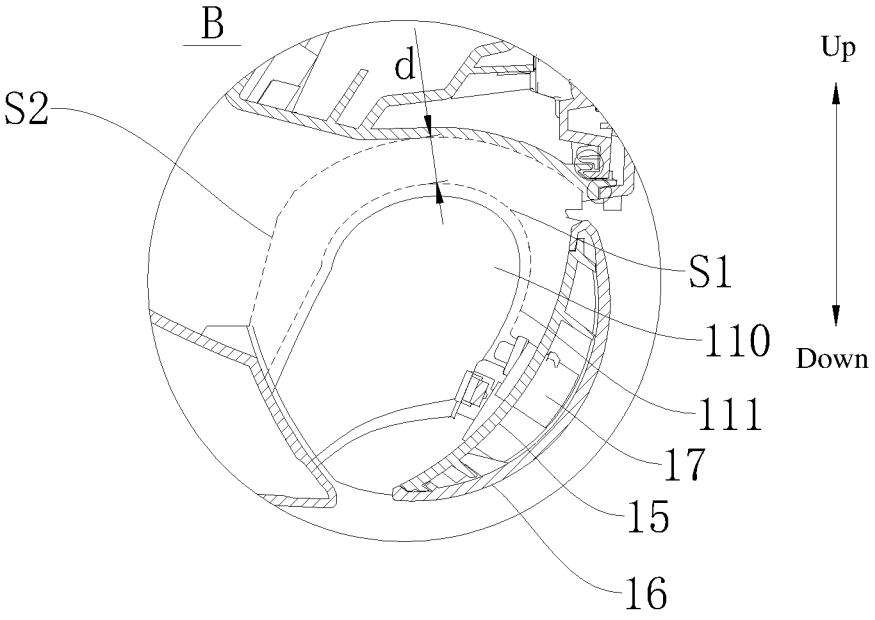
FIG. 18 is an enlarged view of part B in FIG. 17.
Figure 19:
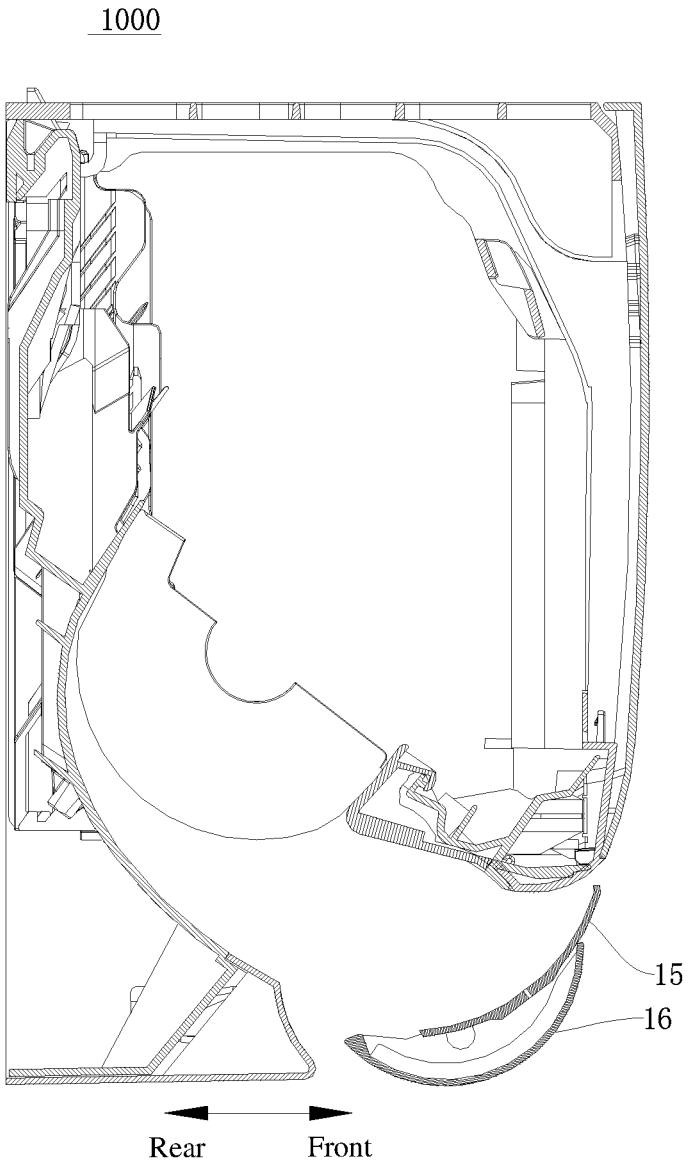
FIG. 19 is a cross-sectional view of an air conditioner according to an embodiment of the present disclosure where an air guide device is in a closed state.

As shown in FIG. 18, a center point D of a contour line of a cross section of the air guiding part (the "center point D" here can be understood as a projection of a geometric center of gravity of the air guiding part on the cross section of the air guiding part) does not coincide with the rotation axis of the air guiding part. That is, the rotation axis of the air guiding part does not pass through the geometric center of gravity of the air guiding part. A line on an inner surface of the air guiding part in parallel with the rotation axis serves as a reference line, and the reference line may be parallel to the arc-shaped outer wall 111. When the air guiding part moves, a distance between the reference line and the arc-shaped outer wall 111 may be equal.

Figure 14:
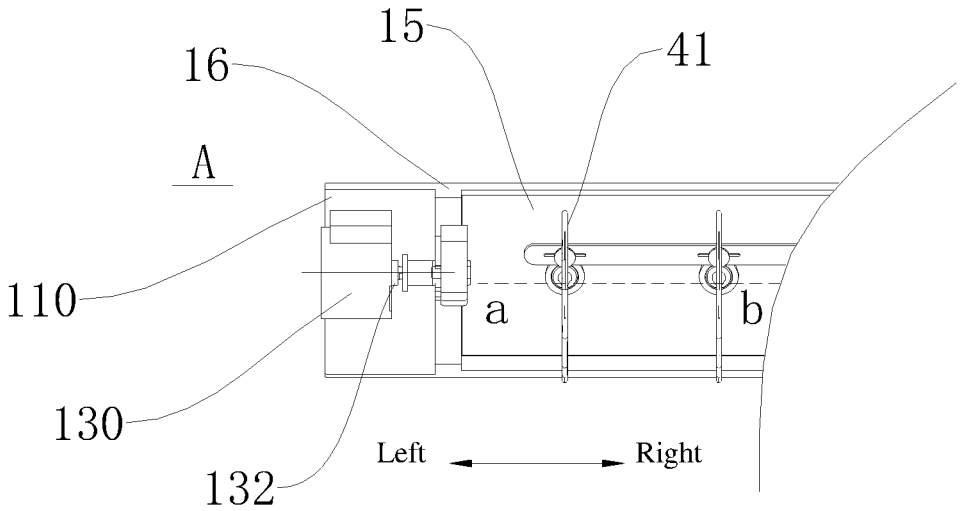
FIG. 14 is an enlarged view of part A in FIG. 13.

As shown in FIG. 14, two ends of the air guiding part can be both connected to the motor shaft 132 of the first motor 130. When an air supply state of the air conditioner indoor unit 1000 needs to be changed, the first motor 130 can drive the air guiding part to rotate. Correspondingly, the motor shaft 132 of the first motor 130 can serve as the rotation axis of the air guiding part, and an extension curve of the motor shaft 132 can serve as the rotation axis of the air guiding part (e.g., c-d shown in FIG. 15). Since the air guiding part is arranged around the outer periphery of the mounting box 110, the extension line of the motor shaft 132 does not pass through the geometric center of gravity of the air guiding part. As a result, during the movement of the air guiding part, as the position of the air guiding part changes, a torque of the gravity of the air guiding part relative to the motor shaft 132 of the first motor 130 is different. Therefore, when the air guiding part moves, the torque of the air guiding part will change accordingly, and a movement track of the air guiding part may be elliptical.

It should be noted that, as shown in FIG. 18, in order to facilitate the description of the movement track of the air guiding part, the line on the inner surface of the air guiding part in parallel with the rotation axis can serve as a reference line; accordingly, the movement track of the reference line (e.g., S2 shown in FIG. 18) can be considered as the movement track of the air guiding part. Therefore, by setting the arc-shaped outer wall 111 to be parallel to the reference line and ensuring that the distance between the reference line and the arc-shaped outer wall 111 is equal when the air guiding part moves, the distance between the reference line and the arc-shaped outer wall 111 can be considered as a distance between the inner surface of the air guiding part and the arc-shaped outer wall 111.

It can also be understood that, during the movement of the air guiding part, there is always a certain space between the air guiding part and the arc-shaped outer wall 111. In this way, when the air guiding part rotates in a larger angular range around the mounting box 110, the probability of interference between any part of the air guiding part and the mounting box 110 can be reduced, thereby improving the reliability of the air guiding part. Moreover, by setting the arc-shaped outer wall 111 to be always parallel to the reference line, the outline of the arc-shaped outer wall 111 (e.g., S1 shown in FIG. 18) and the movement track of the air guiding part tend to be consistent and are relatively spaced apart. Thus, the accommodating space of the mounting box 110 can be increased in unit space, so as to accommodate the first motor 130.

For example, as shown in FIG. 12, the air guiding part is provided at the air outlet of the air conditioner indoor unit 1000, the air guiding part extends in a left-right direction, and a first motor 130 is connected to each of the left and right ends of the air guiding part. As shown in FIG. 12, a mounting box 110 may be arranged on each of the left and right sides of the air guiding part, and the mounting box 110 on the left side is configured to accommodate the first motor 130 on the left side, and the mounting box 110 on the right side is configured to accommodate the first motor 130 on the right side.

Figure 13:
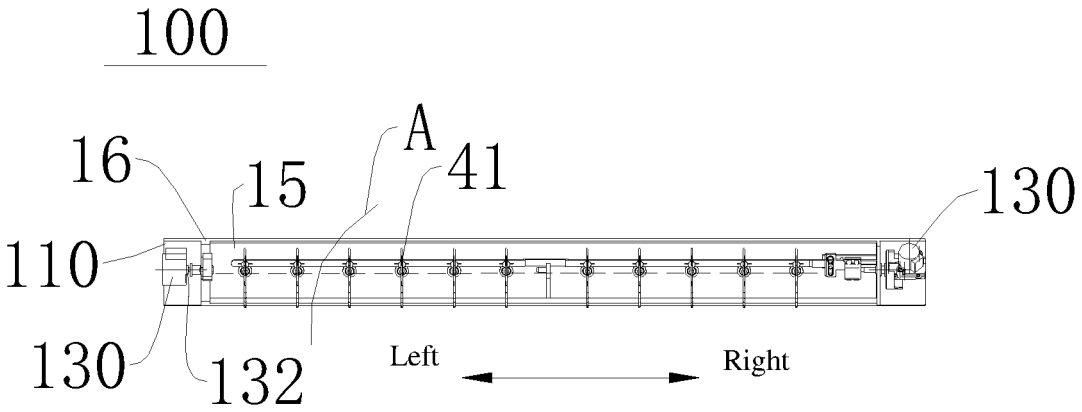
FIG. 13 is a schematic structural diagram of an air guiding device of an air conditioner according to an embodiment of the present disclosure.

As shown in FIGS. 12-14, a left end part of the air guiding part is arranged around the outer periphery of the left mounting box 110, and a right end part of the air guiding part is arranged around the outer periphery of the right mounting box 110. In this way, the mounting boxes 110 on the left and right sides can be both arranged at an inner side of the air guiding part. When the air guiding part moves, as shown in FIG. 18, the movement track of the air guiding part is denoted as S2, the outline of the arc-shaped outer wall 111 is denoted as S1, S1 is elliptical, S2 is also elliptical, and S1 and S2 tend to be the same. A space surrounding the outer periphery of the arc-shaped outer wall 111 exists between the outline S1 of the arc-shaped outer wall 111 and the movement track S2 of the air guiding part.

In some exemplary embodiments, as shown in FIG. 18, the distance between the reference line and the arc-shaped outer wall 111 may be denoted as d, and d is between 1 and 6 mm. For example, the distance between the reference line and the arc-shaped outer wall 111 may be 2 mm, 3 mm, 4 mm, or 5 mm. It should be noted that in the long-term use of the air guiding part, the air guiding part may be deformed. Therefore, by setting a reasonable value of d, the mounting box 110 may have a large accommodating space so as to accommodate the first motor 130 on the one hand; on the other hand, the probability of interference between the air guiding part and the mounting box 110 during the rotation process due to the deformation of the air guiding part can be reduced, thereby improving the reliability of the operation of the air guiding part.

Further, in practical applications, when d is 3 mm, the mounting box 110 can have enough accommodating space for accommodating the first motor 130, and moreover it is satisfied that the air guiding part and the mounting box 110 do not interfere with each other, the layout of the air guiding part and the mounting box 110 is compact, thereby optimizing the spatial layout of the air conditioner indoor unit 1000.

In some exemplary embodiments, as shown in FIG. 18, a cross section of the arc-shaped outer wall 111 on a plane perpendicular to the rotation axis is a curve, and the curve may be at least a part of an ellipse. Therefore, the cross section of the arc-shaped outer wall 111 on the plane perpendicular to the rotation axis can be relatively consistent with the movement track of the air guiding part, so that the movement track of the air guiding part and the cross section of the arc-shaped outer wall 111 on the plane perpendicular to the rotation axis construct a space surrounding the arc-shaped outer wall 111. It can be understood that when the air guiding part moves, there is a space between the air guiding part and the arc-shaped outer wall 111, thereby reducing the probability of interference between the air guiding part and the mounting box 110 when the air guiding part moves.

For example, as shown in FIG. 18, the outline S1 of the arc-shaped outer wall 111 can be considered as the curve of the cross section of the arc-shaped outer wall 111 on the plane perpendicular to the rotation axis, and the outline S1 of the arc-shaped outer wall 111 and the movement track S2 of the air guiding part tend to be consistent and are relatively spaced apart.

In some exemplary embodiments, as shown in FIGS. 13, 14 and 18, the reference line may be located in the middle of the inner surface of the air guiding part. It can be understood that, as shown in FIG. 14, the arc-shaped outer wall 111 is opposite to the inner surface of the air guiding part, and the middle position of the inner surface of the air guiding part has the same geometrical position relative to the upper and lower ends of the air guiding part. Relative to the upper end and the lower end of the inner surface of the air guiding part, the middle position of an inner wall of the air guiding part is closer to the center of gravity of the air guiding part. Therefore, by setting the reference line (e.g., a-b shown in FIG. 14) to be located in the middle of the inner surface of the air guiding part, the movement track of the reference line and the movement track of the air guiding part tend to be consistent and thus the cross section of the arc-shaped outer wall 111 on the plane perpendicular to the rotation axis tends to be consistent with the movement track of the air guiding part, thereby reducing the probability of interference between the air guiding part and the mounting box 110 when the air guiding part moves and also improving the accommodating space of the mounting box 110.

In some exemplary embodiments, as shown in FIGS. 14 and 18, the air guiding part may include an inner air guiding plate 15 and an outer air guiding plate 16, and the inner air guiding plate 15 is connected to the outer air guiding plate 16. A surface of the inner air guiding plate 15 facing away from the outer air guiding plate 16 is configured as an inner surface, and a surface of the outer air guiding plate 16 facing away from the inner air guiding plate 15 is configured as an outer surface. Thus, by constructing the air guiding part as having the outer air guiding plate 16 and the inner air guiding plate 15, the inner air guiding plate 15 can serve as a mounting structure to provide a mounting platform for some components of the air conditioner indoor unit 1000, and the outer air guiding plate 16 can serve as a door for the air outlet of the air conditioner indoor unit 1000 so as to open or close the air outlet. In addition, the outer air guiding plate 16 can be adapted to the housing of the air conditioner indoor unit 1000 to optimize the appearance of the air conditioner indoor unit 1000. For example, as shown in FIG. 2, in order to optimize the layout and performance of the air conditioner indoor unit 1000, some components (e.g., the louver sweeping structure 41) of the air conditioner indoor unit 1000 may be provided on the air guiding part.

Further, as shown in FIG. 18, the inner air guiding plate 15 and the outer air guiding plate 16 may define a mounting cavity 17, and the mounting cavity 17 may have a connecting rib therein to connect the outer air guiding plate 16 and the inner air guiding plate 15. It should be noted that when some components of the air conditioner indoor unit 1000 are provided on the air guiding part, in order to prevent a junction between the component provided on the air guiding part and the air guiding part from being exposed to the outside, the mounting cavity 17 can serve as a structure for accommodating the junction. In this way, the junction can be prevented from being corroded by an external environment (such as, water vapor and dust) and also can be accommodated in a separate space, thereby reducing the probability of interference between the junction and other components of the air conditioner indoor unit 1000.

For example, as shown in FIG. 14, the louver sweeping structure 41 is provided on the inner surface of the inner air guiding plate 15. With reference to FIG. 7, it can be understood that the connecting part of the louver sweep structure 41 and the inner air guiding plate 15 can pass through It is arranged on the inner air guiding plate 15, and the part of the connection part can be inserted into the installation cavity 17.

In addition, since the connecting rib can be provided in the mounting cavity 17 to connect the outer air guiding plate 16 and the inner air guiding plate 15, the outer air guiding plate 16 and the inner air guiding plate 15 can be formed as a whole, so that the outer air guiding plate 16 and the inner air guiding plate 15 keep moving synchronously to improve the reliability of the air guiding part. In addition, based on the airtightness of the mounting cavity 17, the connecting rib cannot be exposed to the outside, thereby beautifying the appearance of the air conditioner indoor unit 1000.

As shown in FIG. 18, in some embodiments, at least one of the outer air guiding plate 16 and the inner air guiding plate 15 may be arc-shaped. That is, the outer air guiding plate 16 may be arc-shaped, and the inner air guiding plate 15 may also be arc-shaped, or, as shown in FIG. 18, both the inner air guiding plate 15 and the outer air guiding plate 16 may be arc-shaped. It should be noted that the arc-shaped structure itself has a high structural strength. Therefore, by configuring at least one of the inner air guiding plate 15 and the outer air guiding plate 16 into an arc shape, the pressure resistance of the air guiding part can be improved, thereby improving the reliability of the air guiding part. In addition, based on the guiding effect of the arc shape, the air supply effect of the air conditioner indoor unit 1000 can also be improved.

In some exemplary embodiments, as shown in FIGS. 19-26, the air guiding device 100 has a closed state where the air outlet of the air conditioner is closed and an open state where the air outlet is open, and the air guiding device 100 has a sliding drive device 30.

In some exemplary embodiments, as shown in FIGS. 19-26, the air guiding device 100 includes an outer air guiding plate 16, an inner air guiding plate 15 and a drive device 30. The inner air guiding plate 15 can be arranged on the outer air guiding plate 16 and is slidable relative to the outer air guiding plate 16. When the air guiding device 100 is in the closed state, the inner air guiding plate 15 extends beyond the front or rear edge of the outer air guiding plate 16 to close the air outlet of the air conditioner together with the outer air guiding plate 16. When the air guiding device 100 is in the open state, the inner air guiding plate 15 is accommodated on an inner side of the outer air guiding plate 16. The sliding drive device 30 drives the inner air guiding plate 15 and the outer air guiding plate 16 to slide relative to each other (in inside-outside and front-rear directions as shown by the arrows in the figures). It should be understood here that the inside-outside and front-rear directions are only for ease of description, and are not a limitation on the actual installation direction of the air guiding device 100.

Therefore, by providing the inner air guiding plate 15 and the outer air guiding plate 16 which can slide relative to each other, when the air outlet of the air conditioner needs to be closed, the inner air guiding plate 15 can extend beyond the front or rear edge of the outer air guiding plate 16 so that the inner air guiding plate 15 and the outer air guiding plate 16 are spread out to each other to expand a windshield area of the air guiding device 100, thereby ensuring the reliable closing of the air outlet; and when the air outlet of the air conditioner needs to be opened, the inner air guiding plate 15 is accommodated on the inner side of the outer air guiding plate 16 so that the inner air guiding plate 15 and the outer air guiding plate 16 overlap each other to reduce the windshield area of the air guiding device 100.

Moreover, compared with an air guiding plate of an air conditioner in a related art, the inner air guiding plate 15 and the outer air guiding plate 16 provided in the present disclosure can slide relative to each other so as to control the windshield area of the air guiding device 100, and thus the reliable closing of the air outlet can be ensured, and the adverse effect of the air guiding device 100 on the outlet air volume can be reduced, thereby ensuring the air supply effect of the air conditioner.

In addition, by providing the inner air guiding plate 15 and the outer air guiding plate 16 which can slide relative to each other, the windshield area of the air guiding device 100 can be adjusted, and there is no need to reduce the area of the air outlet in order to ensure that the air guiding plate closes the air outlet, thereby further increasing the outlet air volume.

For example, as shown in FIGS. 19-24, when the air guiding device 100 is in the closed state, the inner air guiding plate 15 extends beyond the front edge of the outer air guiding plate 16. This can facilitate the increase of the windshield area of the air guiding device 100 and improve the closing effect for the air outlet.

For example, as shown in FIGS. 19-24, the front edge of the inner air guiding plate 15 coincides with the front edge of the outer air guiding plate 16 when the air guiding device 100 is in the open state. This can facilitate the reduction of the windshield area of the air guiding device 100 and reduce the adverse effect of the air guiding device 100 on the outlet air volume.

Figure 20:
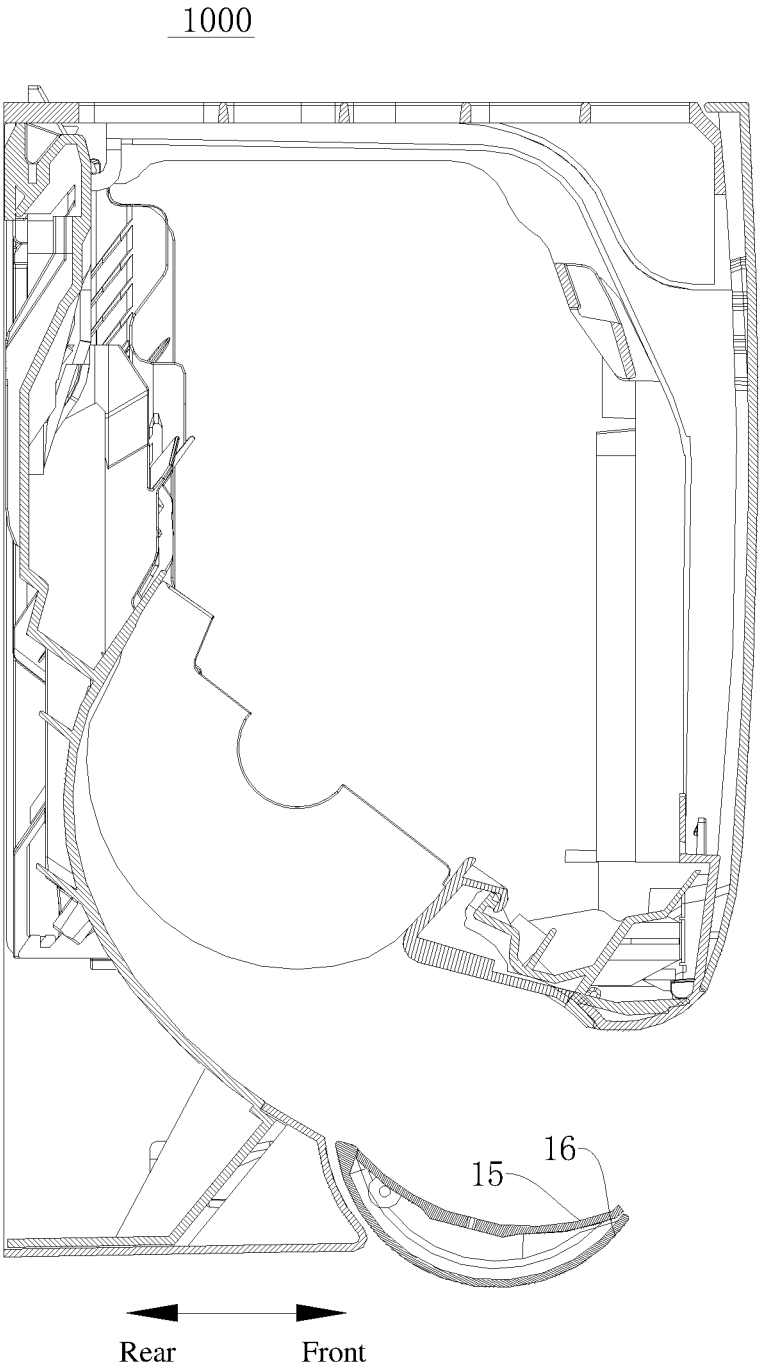
FIG. 20 is a cross-sectional view of an air conditioner according to an embodiment of the present disclosure where an air guiding device is in an open state.
Figure 21:
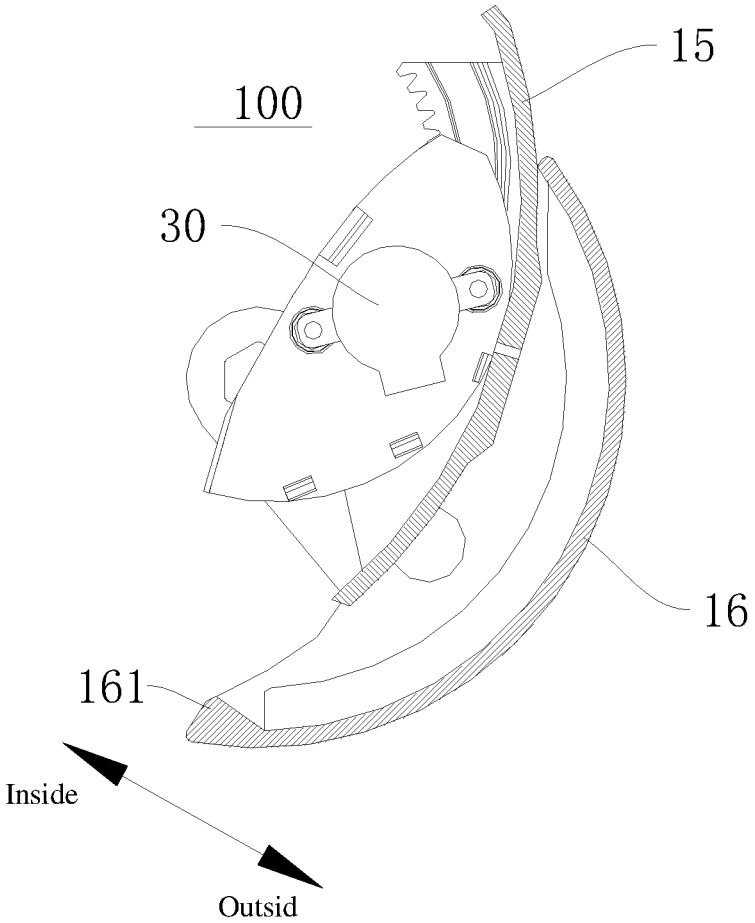
FIG. 21 is a cross-sectional view of an air guiding device of an air conditioner according to an embodiment of the present disclosure where the air guiding device is in a closed state.
Figure 22:
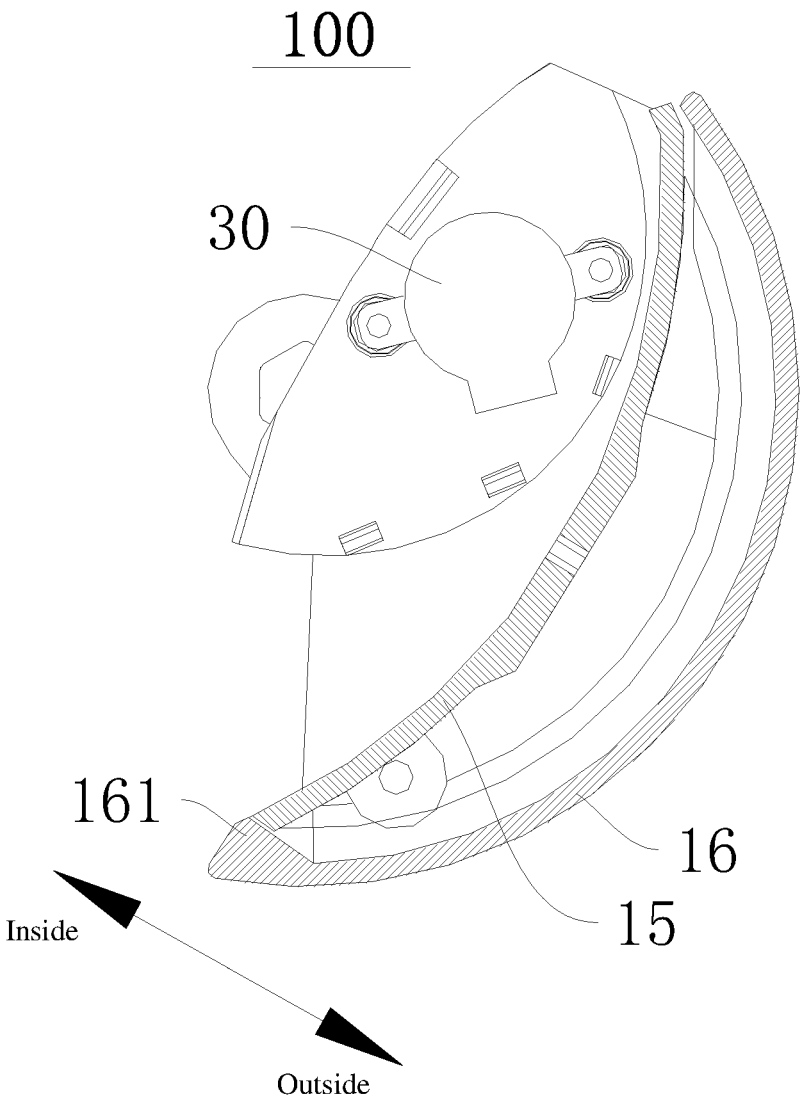
FIG. 22 is a cross-sectional view of an air guiding device of an air conditioner according to an embodiment of the present disclosure where the air guiding device is in an open state.

Advantageously, as shown in FIGS. 19-26, the inner air guiding plate 15 and the outer air guiding plate 16 are each an arc-shaped plate with a middle part protruding outward relative to the front and rear edges. In this way, the inner air guiding plate 15 and the outer air guiding plate 16 can smoothly slide relative to each other, and the air guiding device 100 can be more suitable for matching an air channel in the air conditioner. For example, the air channel in the air conditioner may also be an arc-shaped air channel. As shown in FIG. 20, when the air guiding device 100 is in the open state, the inner surface of the inner air guiding plate 15 may coincide with an extension line of the air channel in the air conditioner.

More advantageously, as shown in FIGS. 19-26, when the air guiding device 100 is in the open state, the front edge and the rear edge of the inner air guiding plate 15 are respectively in contact with the outer air guiding plate 16 and the middle part of the inner air guiding plate 15 is spaced apart from the outer air guiding plate 16. In this way, the inner air guiding plate 15 and the outer air guiding plate 16 can slide smoothly relative to each other, and the air guiding effect of the air guiding device 100 can be improved.

In some exemplary embodiments, as shown in FIGS. 19-26, the rear edge of the outer air guiding plate 16 is provided with a limiting boss 161, and the rear edge of the inner air guiding plate stops against the limiting boss 161 when the air guiding device 100 is in the open state. In this way, the limiting boss 161 can be configured to limit the inner air guiding plate 15, thereby ensuring the movement range of the inner air guiding plate 15 and improving the reliability of the air guiding device 100.

For example, as shown in FIGS. 19-26, one of the outer surface of the inner air guiding plate 15 and the inner surface of the outer air guiding plate 16 is provided with a sliding boss 151 and the other one thereof is provided with a slideway 163. The slideway 163 is slidably fitted in the slideway 163. In this way, the outer air guiding plate 16 and the inner air guiding plate 15 can slide relative to each other more stably and more reliably.

Figure 26:
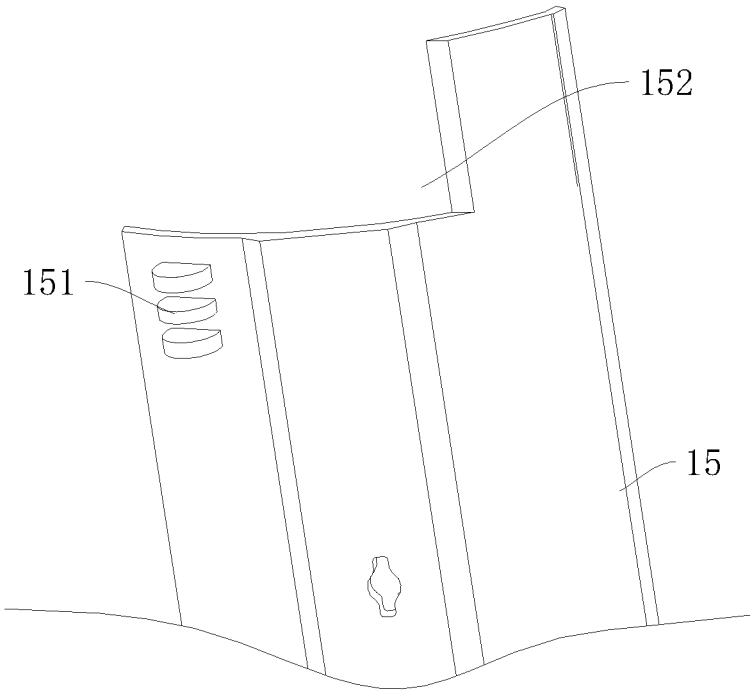
FIG. 26 is a schematic partial structural diagram of an inner air guiding plate in an air guiding device of an air conditioner according to an embodiment of the present disclosure.

For example, as shown in FIG. 26, the sliding boss 151 is arranged on the outer surface of the inner air guiding plate 15 and adjacent to the rear edge of the inner air guiding plate 15. In this way, the structure of the inner air guiding plate 15 can be more reasonable, which facilitates the arrangement of the sliding boss 151.

Advantageously, as shown in FIGS. 21-25, the inner surface of the outer air guiding plate 16 is provided with a rotating shaft base 162, and the outer air guiding plate 16 is reversibly arranged on the air conditioner 1 through the rotating shaft base 162. In this way, the arrangement of the outer air guiding plate 16 can be facilitated.

More advantageously, as shown in FIGS. 23-26, the inner air guiding plate 15 is provided with an avoidance groove 152 for avoiding the rotating shaft base 162. In this way, mutual interference between the rotating shaft base 162 and the inner air guiding plate 15 can be avoided, and the smooth sliding of the inner air guiding plate 15 and the outer air guiding plate 16 can be ensured.

Figure 23:
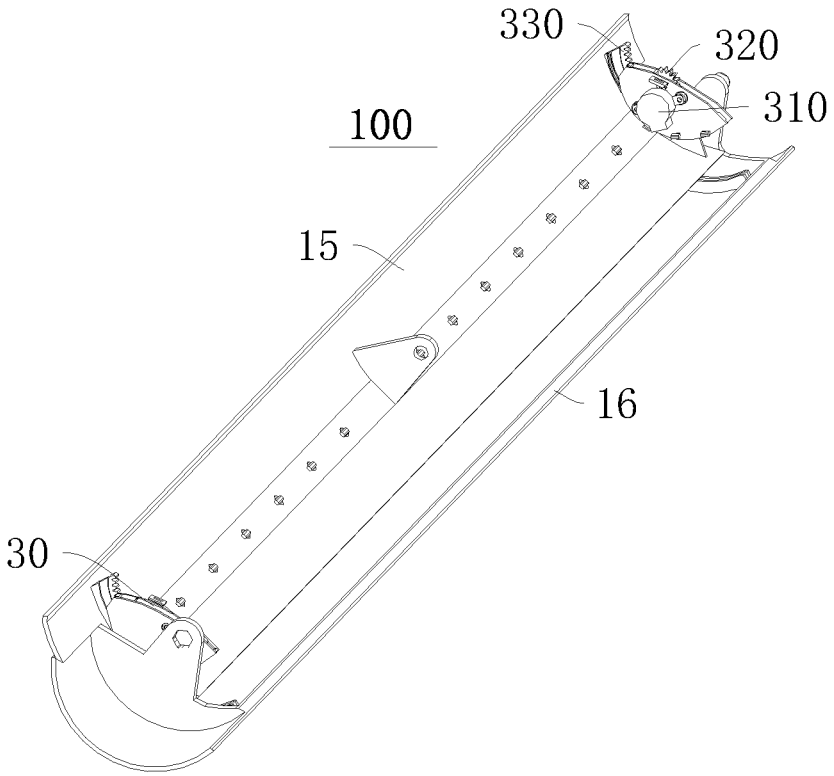
FIG. 23 is a schematic structural diagram of an air guiding device of an air conditioner according to an embodiment of the present disclosure where the air guiding device is in a closed state.
Figure 24:
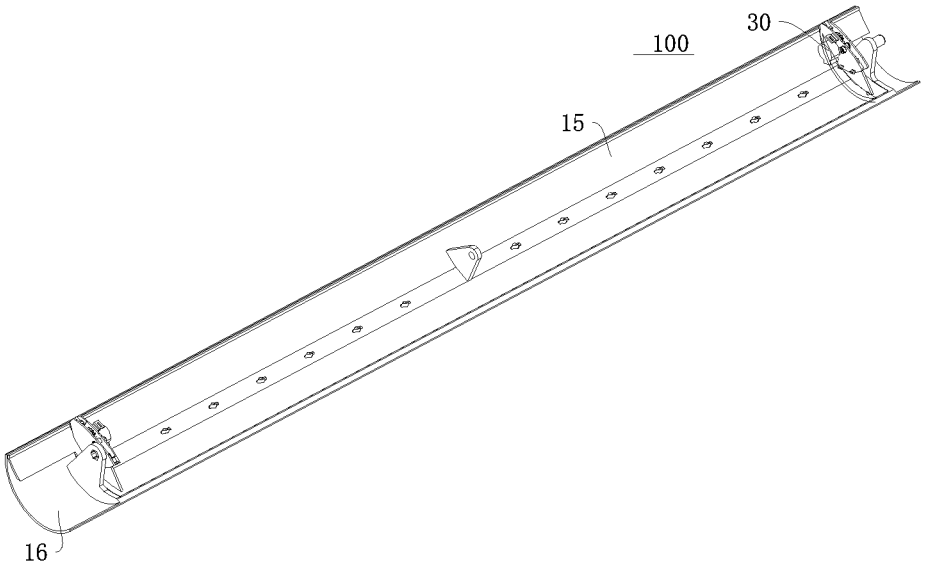
FIG. 24 is a schematic structural diagram of an air guiding device of an air conditioner according to an embodiment of the present disclosure where the air guiding device is in an open state.
Figure 25:
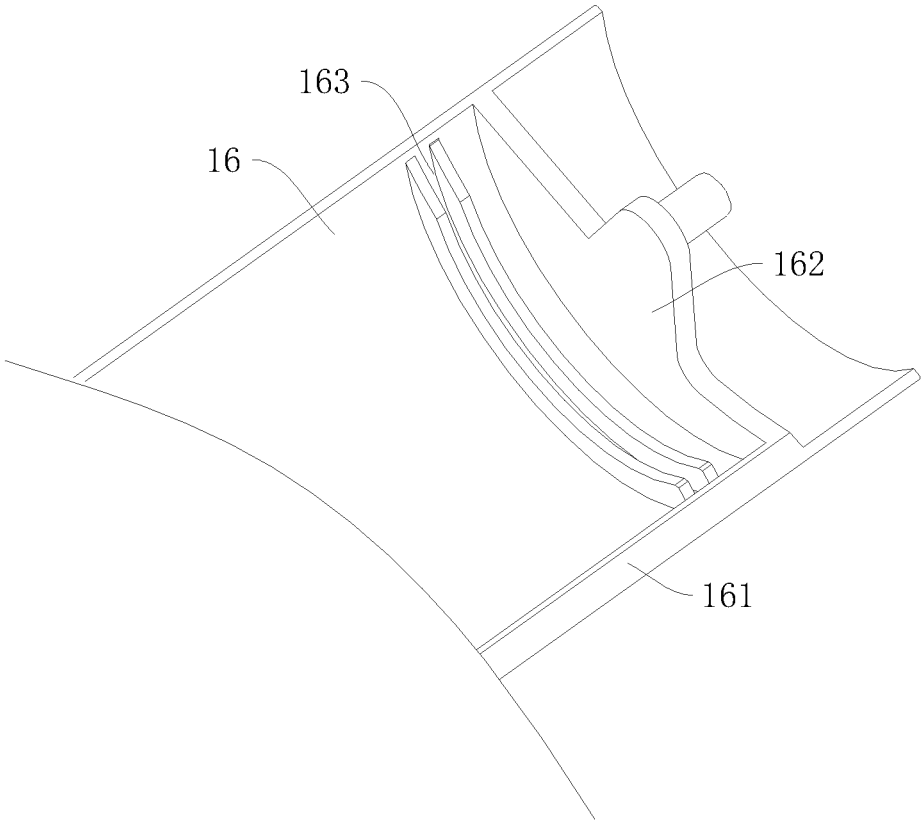
FIG. 25 is a schematic partial structural diagram of an outer air guiding plate in an air guide device of an air conditioner according to an embodiment of the present disclosure.

According to some embodiments of the present disclosure, as shown in FIGS. 23 and 24, two rotating shaft bases 162 are provided and arranged adjacent to two ends of the outer air guiding plate 16, respectively. In this way, the stability of the outer air guiding plate 16 can be improved, and the outer air guiding plate 16 can be stressed more evenly.

In some exemplary embodiments, as shown in FIGS. 21-24, the sliding drive device 30 includes a second motor 310, a gear 320 and a rack 330. The gear 320 is in transmission connection with the second motor 310. The rack 330 is arranged on the inner air guiding plate 15 and engaged with the gear 320. In this way, the second motor 310 can be configured to drive the inner air guiding plate 15 and the outer air guiding plate 16 to slide relative to each other.

For example, as shown in FIGS. 23 and 24, two sliding drive devices 30 are provided and arranged adjacent to two ends of the inner air guiding plate 15, respectively. In this way, the stability of the inner air guiding plate 15 when sliding can be improved, and the inner air guiding plate 15 can be stressed more evenly.

An air conditioner indoor unit 1000 according to an embodiment of the present disclosure is described as follows.

The air conditioner indoor unit 1000 according to the embodiment of the present disclosure is provided with the above-mentioned air guiding device 100.

In the air conditioner indoor unit 1000 according to the embodiment of the present disclosure, the air guiding device 100 is arranged so that the air conditioner indoor unit 1000 can blow uniform airflow into the room, and in the meanwhile the outlet air volume of the air conditioner indoor unit 1000 is large to ensure the temperature adjustment effect of the air conditioner indoor unit 1000.

An air-conditioning system according to an embodiment of the present disclosure is described as follows.

The air-conditioning system according to the embodiment of the present disclosure is provided with the above-mentioned air conditioner indoor unit 1000.

In the air-conditioning system according to the embodiment of the present disclosure, the air conditioner indoor unit 1000 is arranged so that the air-conditioning system can blow uniform airflow into the room, and in the meanwhile the outlet air volume of the air-conditioning system is large to ensure the temperature adjustment effect of the air-conditioning system.

In the description of the present disclosure, it is to be understood that the orientations or positional relationships, indicated by the terms "central", "longitudinal", "lateral", "length", "width", "thickness", "up", "down", "front", "rear", "left", "right", "inside", "outside", "axial", "circumferential", and the like, are based on the orientations or positional relationships shown in the drawings and are only for the purpose of facilitating and simplifying the description of the present disclosure, rather than indicating or implying that the described device or element must have a particular orientation or must be constructed and operated in a particular orientation, and therefore they cannot to be construed as limiting the present disclosure.

Moreover, the terms "first" and "second" are used for descriptive purposes only and are not to be construed as indicating or implying a relative importance or implicitly indicating the number of technical features indicated. Thus, features defined by the term "first" or "second" may include one or more such features, either explicitly or implicitly. In the description of the present disclosure, the meaning of "a plurality of" refers to more than two, unless specifically defined otherwise.

In the present disclosure, unless otherwise stated and defined explicitly, the terms such as "install" "link", "connect", and "fix" should be understood in a broad sense; for example, a connection may be a fixed connection, a detachable connection, or an integrated connection; may be a mechanical connection or an electrical connection; and may be a direct connection, an indirect connection through an intermediate medium, or a communication inside two components or interaction between two components. For those skilled in the art, the specific meanings of the above terms in the present disclosure can be understood based on a specific situation.

In the description of the present specification, the description with reference to the terms "one embodiment", "some embodiments", "example", "specific example", or "some examples" and the like means specific features, structures, materials or characteristics described in connection with the embodiment or example are included in at least one embodiment or example of the present disclosure. In the present specification, the schematic representation of the above terms is not necessarily directed to the same embodiment or example. Furthermore, the specific features, structures, materials, or characteristics described may be combined in a suitable manner in any one or more embodiments or examples. In addition, those skilled in the art can integrate and combine various embodiments or examples described in the present specification, as well as features of various embodiments or examples, without contradicting each other.

Although the embodiments of the present disclosure have been shown and described, it would be understood that the above-described embodiments are illustrative and are not to be construed as limiting the scope of the present disclosure. Changes, modifications, substitutions and variations of the above-described embodiments may be made by those skilled in the art within the scope of the present disclosure.

What is claimed is:

1. An air guiding device comprising:

at least one air guiding part configured to guide airflow blown out of an air outlet of an air-conditioning system, the at least one air guiding part being configured to rotate from a first angle to a second angle to change a guiding direction of the airflow from a first direction to a second direction; and a flow straightening grid provided on at least one of an upstream side and a downstream side of the at least one air guiding part, wherein the flow straightening grid is configured to rotate together with the at least one air guiding part between the first angle and the second angle such that when the flow straightening grid is rotated to the first angle with the at least one air guiding part, the flow straightening grid straightens the airflow in the first direction and when the flow straightening grid is rotated to the second angle with the at least one air guiding part, the flow straightening grid straightens the airflow in the second direction;

wherein an end cap is fitted over each of two ends of the at least one air guiding part in a length direction of the air outlet, a mounting space is defined in the end cap, and an air-guide-part drive device for driving the at least one air guiding part to rotate is arranged in the mounting space; and wherein the end cap is provided with an avoidance notch for avoiding the air-guide-part drive device when rotating together with the air guiding part.

2. The air guiding device according to claim 1, wherein the at least one air guiding part comprises a plurality of air guiding parts, and the plurality of air guiding parts are located in different positions at the air outlet.

3. The air guiding device according to claim 2, wherein the plurality of air guiding parts are arranged in sequence along a length direction of the air outlet.

4. The air guiding device according to claim 3, wherein:

the plurality of air guiding parts comprise two air guiding parts; and two ends of the air outlet in the length direction are each provided with an air-guide-part drive device; and each of the air-guide-part drive devices is configured to drive a respective one of the two air guiding parts to rotate.

5. The air guiding device according to claim 2, wherein:

the plurality of air guiding parts are arranged in sequence along a width direction of the air outlet; and at least one end of the air outlet in a length direction is provided with an air-guide-part drive device for driving the plurality of air guiding parts to rotate.

6. The air guiding device according to claim 1, wherein the end cap is fixed in the air-conditioning system.

7. The air guiding device according to claim 1, further comprising a louver sweeping structure, a louver drive structure, and a louver transmission structure, wherein:

the at least one air guiding part is provided with the louver sweeping structure;

a plurality of sweeping blades of the louver sweeping structure are spaced apart and swingable along a rotation axis of the at least one air guiding part; and the louver drive structure is configured to cause, through the louver transmission structure, the plurality of sweeping blades of the louver sweeping structure to swing along the rotation axis of the air guiding part.

8. The air guiding device according to claim 4, wherein:

each of the air guide parts comprises an arc-shaped plate, a surface of the arc-shaped plate being configured as an airflow guide surface;

an axis of a cylinder where the arc-shaped plate is located serves as a rotation axis of the each of the air guiding parts; and at least one end of the arc-shaped plate in an axial direction is provided with a connecting plate configured to be in rotatory fit with a corresponding one of the each of the air-guide-part drive devices.

9. The air guiding device according to claim 1, wherein the at least one air guiding part has a blocking position for blocking the air outlet, a hot air guiding position for guiding the airflow downward, and a cold air guiding position for guiding the airflow upward.

10. The air guiding device according to claim 9, wherein when the air guiding part is at the hot air guiding position or the cold air guiding position, an outline of an airflow guide surface of the at least one air guiding part is in smooth connection with an outline of an internal air channel of the air-conditioning system, the at least one air guiding part is configured to rotate from the blocking position to the hot air guiding position by an angle $\alpha$, and the at least one air guiding part is configured to rotate from the blocking position to the cold air guiding position by an angle $\beta$, wherein $\alpha$ is 30°-80° and $\beta$ is 40°-110°.

* * * * *